US006796648B2

(12) United States Patent
Ohashi

(10) Patent No.: US 6,796,648 B2
(45) Date of Patent: Sep. 28, 2004

(54) INK JET RECORDING APPARATUS AND METHOD FOR PERFORMING INK JET RECORDING

(75) Inventor: Tetsuyo Ohashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/022,339

(22) Filed: Dec. 20, 2001

(65) Prior Publication Data

US 2002/0089564 A1 Jul. 11, 2002

(30) Foreign Application Priority Data

Dec. 27, 2000 (JP) ..... 2000-398072
Dec. 27, 2000 (JP) ..... 2000-398164

(51) Int. Cl.[7] ..... B41J 2/01
(52) U.S. Cl. ..... 347/104; 347/36
(58) Field of Search ..... 347/104, 36, 16, 347/105; 400/656, 648

(56) References Cited

U.S. PATENT DOCUMENTS 6,239,817 B1 * 5/2001 Meyer ..... 347/36

FOREIGN PATENT DOCUMENTS

JP 11-321016 11/1999

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

There is disclosed an ink jet recording apparatus capable of performing recording on the full surface of a recording sheet without any complication, enlargement or cost increases, and without any need to execute secondary processing after the end of recording. Platen ribs for guiding and supporting the recording sheet are provided in parallel within the ink discharge nozzle row length of a recording head, and each rib constituting one platen rib row is disposed in a position between the adjacent ribs of another platen rib row. When recording is performed on the leading end or the rear end of the recording sheet, recording data is divided into data according to a platen rib array, and one-line recording data is recorded by a plurality of scanning operations.

11 Claims, 27 Drawing Sheets

10
113d
113f
113g
113g
113f
113g
113f
113g
113f

INK JET RECORDING APPARATUS AND METHOD FOR PERFORMING INK JET RECORDING

BACKGROUND OF THE INVENTION

1. Field of the Invention

The present invention relates to an apparatus and a method for ink jet recording, which perform recording on a recording medium by discharging ink. More specifically, the invention relates to an ink jet recording apparatus and a method for performing ink jet recording, which can perform recording on the full surface of the recording medium without any blank spaces.

2. Related Background Art

Conventionally, since recording operated only in a range completely coincident with the full surface of a recording sheet was not practical because of a form error of the recording sheet, a shortage of recording sheet conveying accuracy in the recording apparatus side, etc., the recording operation was normally started from a place inside by a predetermined distance from the end of the recording sheet. Accordingly, the result of recording usually had spaces (margins) of no recording along the end of the sheet.

However, as shown in printing services of silver salt photography, there are many who prefer a recording result of no blank spaces (no margins) and, in the ink jet recording apparatus, some means have been put to practical use for performing recording on the full surface of the recording sheet, on which recording has already been made, without any blank spaces. Such means are largely divided into a method of processing the recording sheet after recording, and a method of compensating for the above-described error or shortage of accuracy by performing a recording operation in a range exceeding an area of the recording sheet.

As one of the former examples, a method has been available, which obtains a desired recording result by providing a region surrounded with a perforated line, and an extra portion outside this region, to be cut off along the perforated line, on the recording sheet, performing recording not only in the region surrounded with the perforated line but also even in this extra portion, and cutting off the extra portion after the end of the recording operation. An example is shown in FIG. 31. On a recording sheet 13 including a recording region 53 formed by four perforated lines 52, recording is carried out in a region exceeding the recording region 53. After the end of recording, however, extra portions outside the recording region 53 are removed along the perforated lines 52. Thus, the result of recording on the recording sheet has no blank spaces (recording without margins) after the removal of the extra portions.

As disclosed in Japanese Patent Application Laid-Open No. 11-321016, there is a method of obtaining a desired recording result by performing recording on long roll paper, and cutting off only recorded portions after the end of the recording operation.

As one of the latter examples, regarding a recording operation performed in a range exceeding an area of the recording sheet, in order to prevent the staining of the backside of the recording sheet by ink directly discharged to a platen for holding the recording sheet, an apparatus has been put to practical use, which directly holds only the backside of the recording sheet with the platen hidden when recording is performed on a leading end or a rear end of the recording sheet.

In addition, as shown in FIG. 32, a method has been presented, which obtains a desired recording result by providing a recording sheet supporting member 50 movable in a direction similar to the scanning direction of a recording head 10, moving the recording sheet supporting member 50 while detecting a width of a recording sheet 13 by recording sheet detecting means 51, and executing recording of one line by dividing it into a plurality of portions.

In the foregoing conventional examples, however, some constraints have been imposed on the execution of recording on the full surface of the recording sheet without any blank spaces.

Specifically, in the case of the method of processing the recording sheet after recording, it is necessary to use a recording sheet having a size larger than that of the recording sheet obtained after the recording, and the recording apparatus itself must deal with such a size. Consequently, the enlargement of the recording apparatus has been inevitable. The user must process the recording sheet himself, accordingly complicating the operation. In addition, in the case of the method of manually removing the extra portions of the recording sheet along the perforated line, cut surfaces are not neatly aligned, resulting in a finishing problem.

In the case of the method of cutting the long roll paper after recording thereon, it is necessary to provide cutting means in the recording apparatus, resulting in increases in the size and costs of the recording apparatus. In the case of the method, in which the user cuts the long roll paper after continuous image recording thereon, it is difficult to cut the paper without any shifting at an image boundary, complicating the operation.

Furthermore, in the method of performing a recording operation in a range exceeding an area of the recording sheet, it is necessary to provide a mechanism for moving the platen in synchronization with the conveyance of the recording sheet or a mechanism for moving the platen in synchronization with the movement of a carriage. Consequently, complication and enlargement of the apparatus, and a cost increase have been inevitable.

SUMMARY OF THE INVENTION

The present invention was made to solve the foregoing problems inherent in the conventional art, and it is an object of the invention to provide an ink jet recording apparatus capable of performing recording on the full surface of a recording sheet without any blank spaces, and improving recording sheet finishing, and operability, without complicating or enlarging the recording apparatus, and without any cost increases.

Other objects of the invention are to provide an apparatus and a method for ink jet recording, which provide a rib row including a plurality of ribs in a direction intersecting the conveying direction of a recording medium such that the ribs are disposed to be different from one another, and disposing at least two rows on a platen along the conveying direction of the recording medium when the recording medium is conveyed onto the platen disposed to face a recording head for executing recording by discharging recording liquid droplets, and ink jet recording is performed, and performing recording except for recording data corresponding to each rib position, at each of at least the two rib rows when a recording operation is performed on a leading end or a rear end of the recording medium in the conveying direction thereof, thereby completing predetermined one-line recording.

DETAILED DESCRIPTION OF THE PREFERRED EMBODIMENTS

Next, description will be made of the preferred embodiments of the present invention with reference to the accompanying drawings.

First Embodiment

Figure 1:
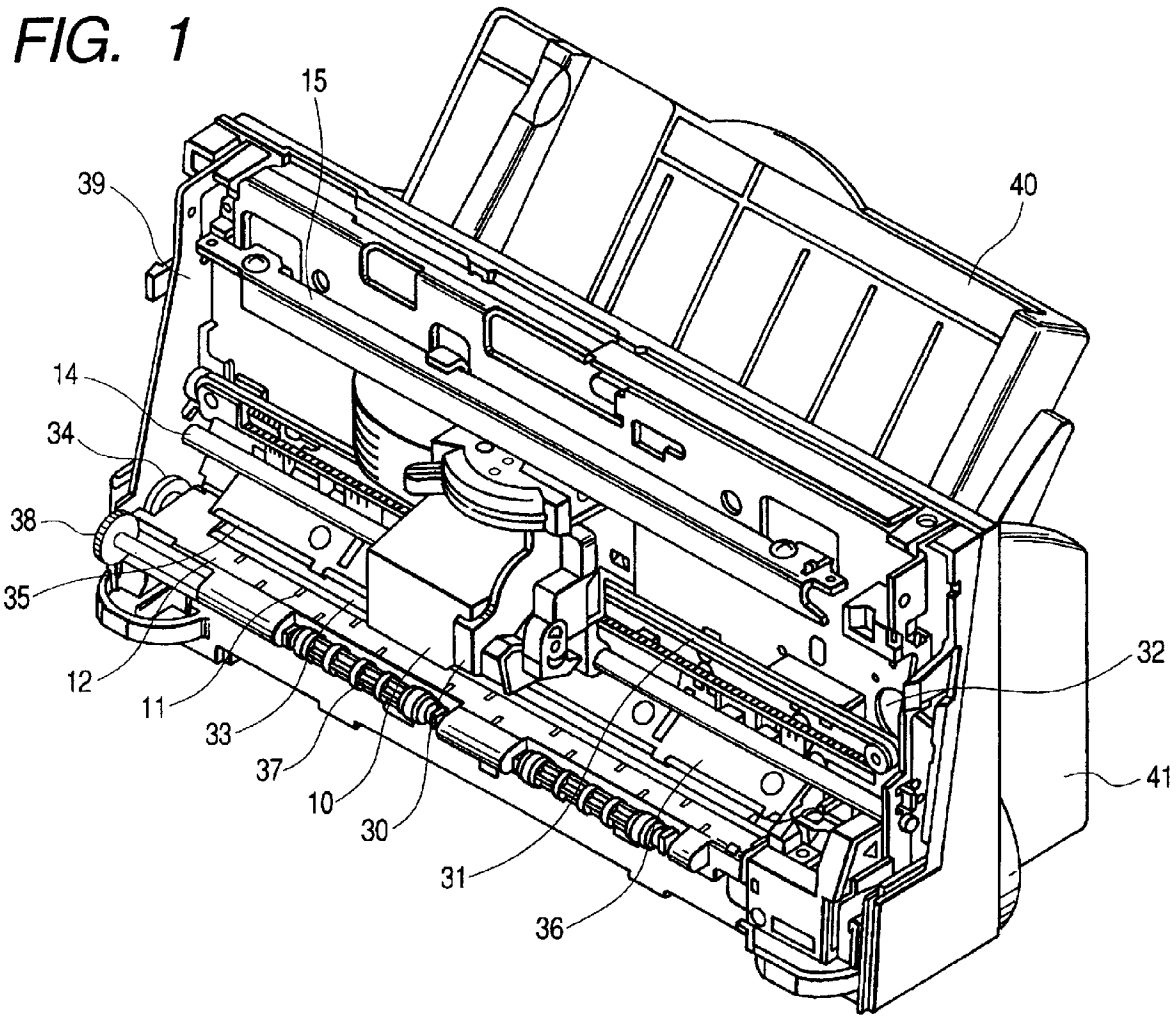
FIG. 1 is a schematic perspective view showing, in outline, an entire ink jet recording apparatus according to a first embodiment of the present invention.

FIG. 1 is a schematic perspective view showing an example of the entire recording unit of an ink jet recording apparatus of the invention. In FIG. 1, a reference numeral 12 denotes a platen ink absorber disposed in contact with a platen; 38 a paper ejection roller gear fixed coaxially to a discharge roller 37; 39 a chassis for supporting each portion of the recording apparatus; and 41 the exterior of the recording apparatus.

First, description will be made of the components and the operation of the ink jet recording apparatus by referring to FIG. 1.

As schematically shown, the ink jet recording apparatus of the embodiment comprises a paper feeding unit, a sheet conveying unit, a discharge unit, and a carriage unit.

The paper feeding unit includes an automatic sheet feeder (ASF) 40 for feeding recording sheets 13 as loaded recording materials one by one.

A plurarity of recording sheets 13 are stacked, and loaded on the paper feeding tray of the ASF 40. The recording sheets 13 on the paper feeding tray are separated and conveyed, starting from its uppermost sheet, by the rotation of a paper feed roller (not shown), and fed through a sheet conveying path (not shown) into the sheet conveying unit.

The sheet conveying unit includes an LF roller 33 for conveying the recording sheet 13, and a pinch roller 35 disposed oppositely to the LF roller 33 to hold the recording sheet 13 with the same.

The pinch roller 35 is held by a pinch roller holder 36. An LF roller 34 is fixed coaxially to the LF roller 33, and a driving force is transmitted from an LF motor (not shown) as a driving source through the LF roller gear 34 to the LF roller 33. The pinch roller 35 disposed oppositely to the LF roller 33 is pressed through the pinch roller holder 36 to the LF roller 33 by an elastic member (not shown). After the feeding-in of the recording sheet 13 by the ASF 40, by starting the rotation of the LF roller 33, the leading end of the recording sheet 13 is held between the LF roller 33 and the nip portion (contact portion) of the pinch roller 35. Since a friction coefficient is set high between the LF roller 33 and the recording sheet 13, the recording sheet 13 is conveyed with almost no slipping in correspondence with the LF roller 33.

The recording sheet 13 conveyed by the LF roller 33 is guided to, and supported by a rib row provided in the platen 11, and then guided to the discharge unit. Each rib provided in the platen 11 to guide and support the recording sheet 13 has resistance set low by reducing its contact area with the recording sheet 13. Accordingly, the recording sheet 13 is smoothly conveyed to the discharge unit.

Figure 12:
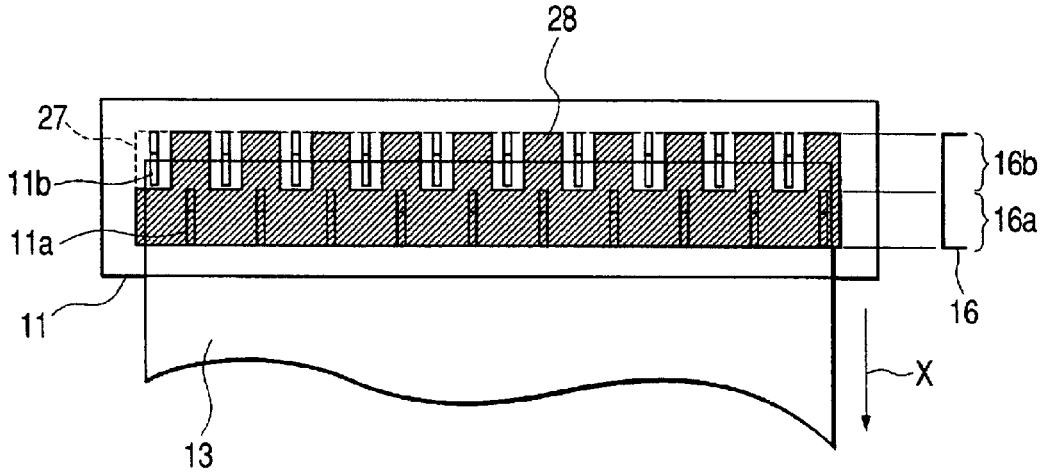
FIG. 12 is a schematic plan view showing the recording portion of the sheet leading end of the ink jet recording apparatus of the first embodiment of the invention.

The discharge unit includes a discharge roller 37 for conveying a sheet on the downstream side of sheet conveyance, and a not-shown gear. This gear is a driven rotor for discharging, and provided with a number of projections in its peripheral surface. In FIG. 12, this member is disposed above the discharge roller 37.

The discharge roller 37 is connected to the LF roller 38 by a gear train, and adapted to be rotated in synchronization. As it is similarly pressed to the discharge roller 37 by the elastic member, the gear can convey the recording sheet 13 while holding it as in the case of the LF roller.

Basically, the recording sheet 13 is conveyed by being held between the LF roller 33 and the pinch roller 35, and between the discharge roller 37 and the gear, and then a recording operation is performed. However, to enlarge an area of a recording portion with respect to an area of the recording sheet 13, the recording operation can be performed only by holding the recording sheet between the LF roller 33 and the pinch roller 35 when recording is executed on the leading end of the recording sheet 13, and between the discharge roller 37 and the gear when recording is executed on the rear end of the recording sheet 13.

The carriage unit includes a carriage 30 scanned by loading a recording head 10 for executing recording by discharging ink, and a guide shaft 14 and a guide rail 15 for guiding the carriage 30 to be reciprocated in a direction intersecting the conveying direction of the recording sheet. The guide shaft 14 and the guide rail 15 are provided to be extended along the scanning direction of the carriage 30.

A carriage belt 31 is attached to the carriage 30, and hung to be tense between the pulley of a carriage motor 32 as a driving source for the carriage 30 and an idler pulley attached to a chassis 39. With such a constitution, the forward/backward rotation of the carriage motor 32 is converted into a reciprocating linear motion of the carriage 30.

As the recording head 10 faces the platen 11, recording can be executed by a line unit on the recording sheet 13 by discharging ink droplets through the ink discharge nozzle provided in the recording head 10 by a timing synchronized with the movement of the carriage 30. For the recording head 10, one may be selected from a head, which includes electrothermal converting elements provided in a plurality of nozzles communicated with a common recording liquid chamber, supplies thermal energy to recording liquid in each nozzle by applying an electric pulse as a recording signal to the electrothermal converting element, and uses a bubble pressure generated at the time of recording liquid bubbling caused by the state change of the recording liquid in this case for discharging recording liquid droplets, a head which uses pressure energy generated by a vibrating element, e.g., a piezo element, for discharging recording liquid droplets, different from the electrothermal converting element, etc.

After the end of recording on the recording sheet 13, the recording sheet 13 is discharged out of the recording apparatus by the above-described discharge unit.

The components and the operation of the ink jet recording apparatus of the invention have been described.

Next, detailed description will be made of a recording method, especially a method of recording on the leading end and the rear end of the recording sheet 13, by referring to FIGS. 2 to 12.

First, by using a flowchart of FIG. 2, which illustrates the recording operation on the leading end of the sheet, recording with no blank spaces (recording with no margins) on the leading end of the sheet will be described.

Figure 2:
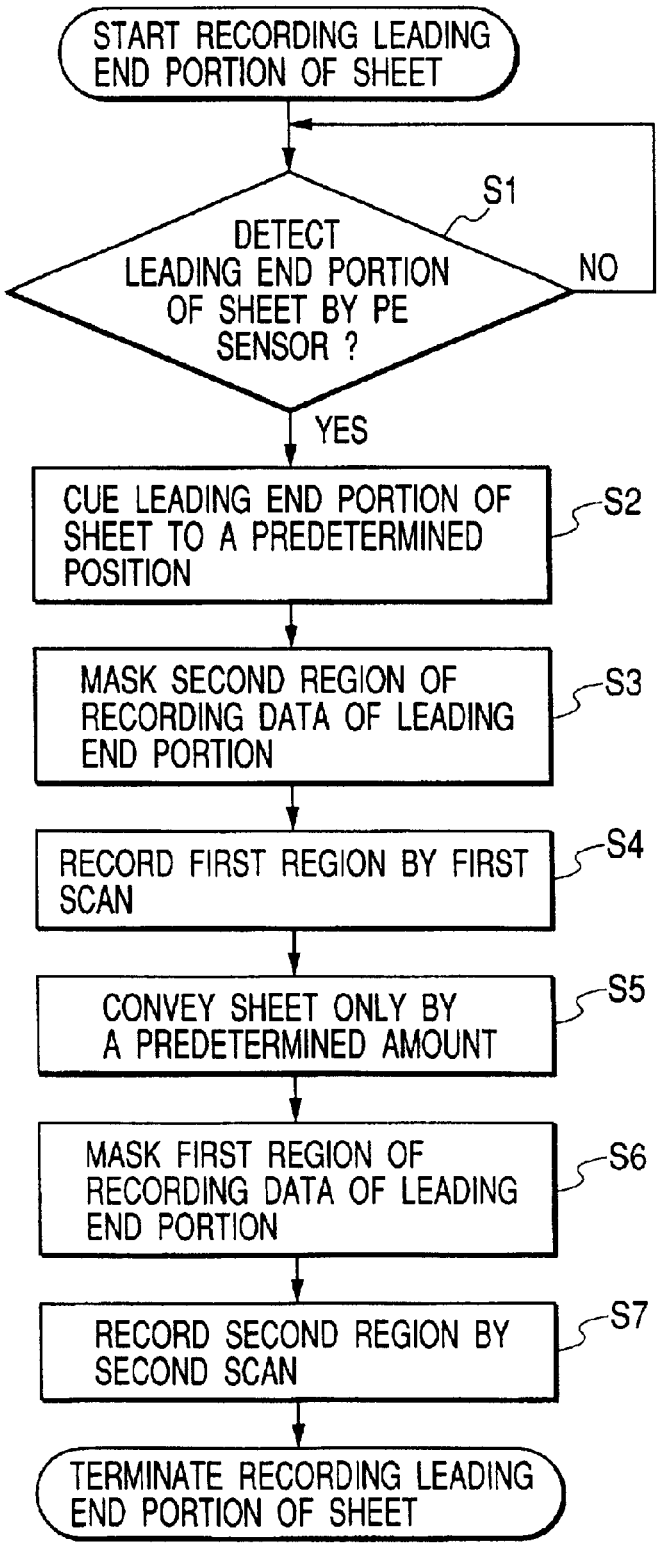
FIG. 2 is a flowchart schematically showing a recording operation of the ink jet recording apparatus of the first embodiment of the invention.

When the recording sheet 13 is conveyed, and the leading end of the recording sheet 13 is detected by a not-shown paper end (PE) sensor, a recording operation on the leading end of the sheet is started (step S1 of FIG. 2).

Figure 3:
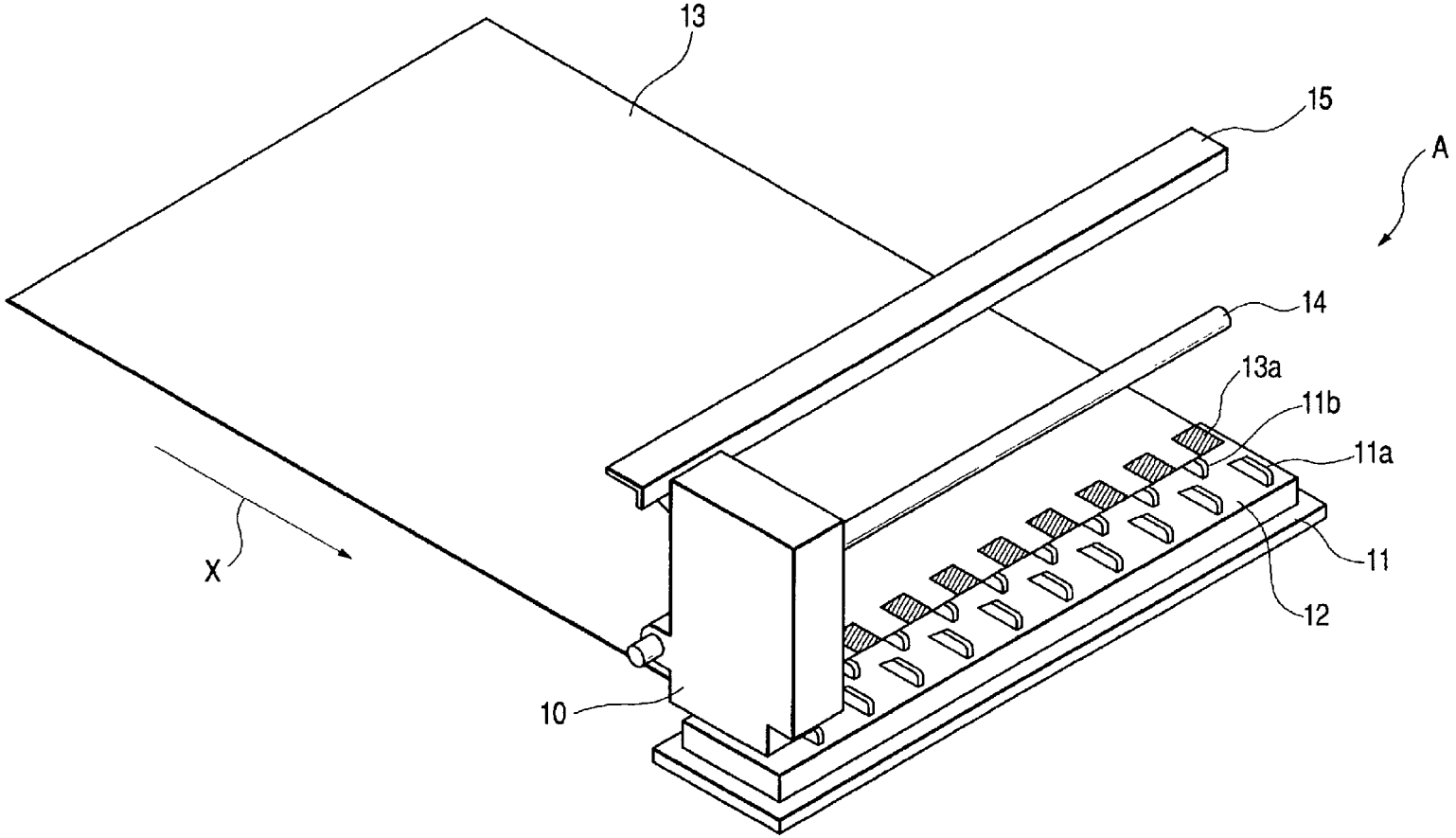
FIG. 3 is a schematic perspective view showing a recording unit of the ink jet recording apparatus of the first embodiment of the invention.

Then, to cue the leading end of the recording sheet 13 to a predetermined position, the LF motor is driven to rotate the LF roller forward (step S2 of FIG. 2). The predetermined position means a position satisfying a relation between the recording head 10 and the recording sheet 13 shown in FIG. 3. FIG. 3 is a schematic perspective view showing only a portion necessary for explanation, regarding an example of the recording unit of the ink jet recording apparatus of the invention.

Figure 4:
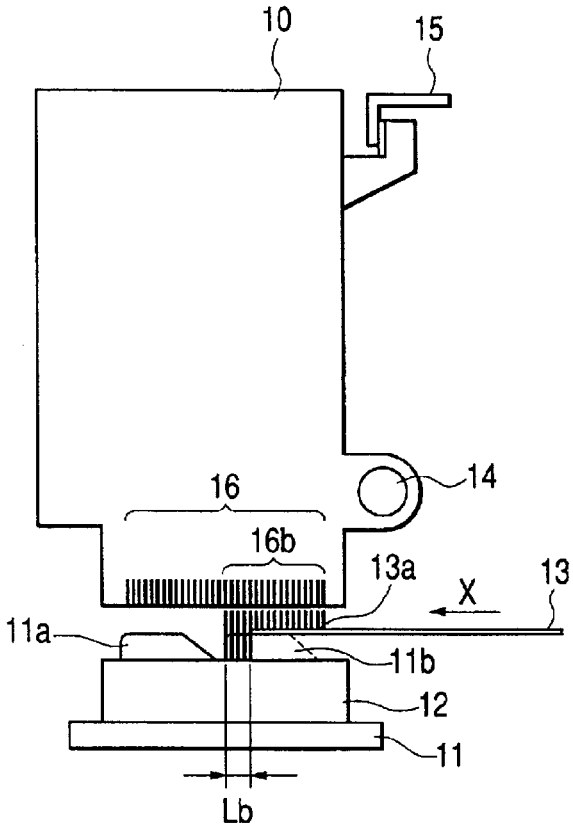
FIG. 4 is a schematic side view showing the recording unit of the ink jet recording apparatus of the first embodiment of the invention.
Figure 5:
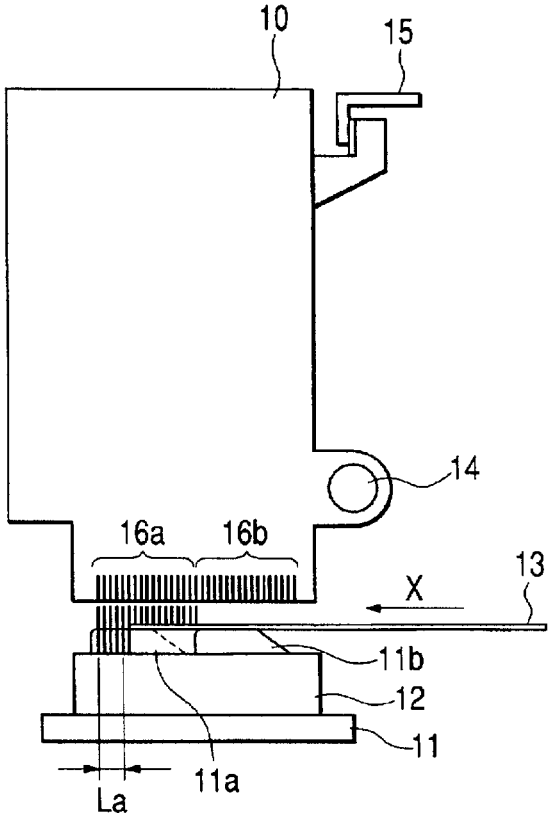
FIG. 5 is a schematic side view showing the recording unit of the ink jet recording apparatus of the first embodiment of the invention.

Here, to clarify a positional relation, FIG. 4 shows a schematic side view of the recording apparatus when seen from the arrow direction A of FIG. 3. In the drawing, a reference numeral 16 denotes an ink discharge nozzle row provided in the recording head 10. The discharge nozzle row 16 includes a plurality of nozzles arrayed roughly linearly, and roughly a half of the upstream side thereof in a sheet conveying direction X is called a discharge nozzle row **16*b* (second nozzle row). Similarly, as shown in FIG. 5, roughly a half of the downstream side thereof in the sheet conveying direction X is called a discharge nozzle row 16*a*** (first nozzle row).

The predetermined position for cuing during the recording operation on the leading end of the sheet indicates a state, where the leading end of the recording sheet 13 is within the range of the discharge nozzle row **16*b*, and located before the most downstream side of the discharge nozzle row 16*b* by a distance Lb. A reason for setting such a distance Lb is as follows. That is, if the conveying of the recording sheet is in an ideal state, and the relative positions of the leading end of the recording sheet 13 and the discharge nozzle of the recording head 10 can be established, then by starting the recording operation from the head portion of the recording sheet 13 with Lb=0, it is possible to perform recording with no blank spaces in the leading end. In actuality, however, there may be a shortage of accuracy of the PE sensor for detecting the position of the recording sheet, or there may be a loss of parallelism between the leading end part of the recording sheet and the scanning direction of the carriage 30** caused by the slightly oblique conveying of the recording sheet. Thus, with Lb=0, small blank spaces may be generated in the leading end, or unexpected discharging of ink droplets to the outside of the recording sheet may occur. It is not impossible to devise means for completely preventing such a problem, but it is not advisable to adopt such means because of cost consideration.

As described above, by setting a proper distance Lb, even if certain variance occurs in various accuracies, it is possible to assure that the leading end of the recording sheet 13 is always in the region of the discharge nozzle row 16*b*. No blank spaces are generated in the leading end.

In the described case, data necessary for recording must be foreseen, including one regarding the distance Lb. In actual practice, therefore, it is necessary to prepare data of a region slightly larger than that to be recorded on the recording sheet.

After the end of the cuing of the recording sheet carried out in the foregoing manner, a recording operation is started in next step.

Figure 6:
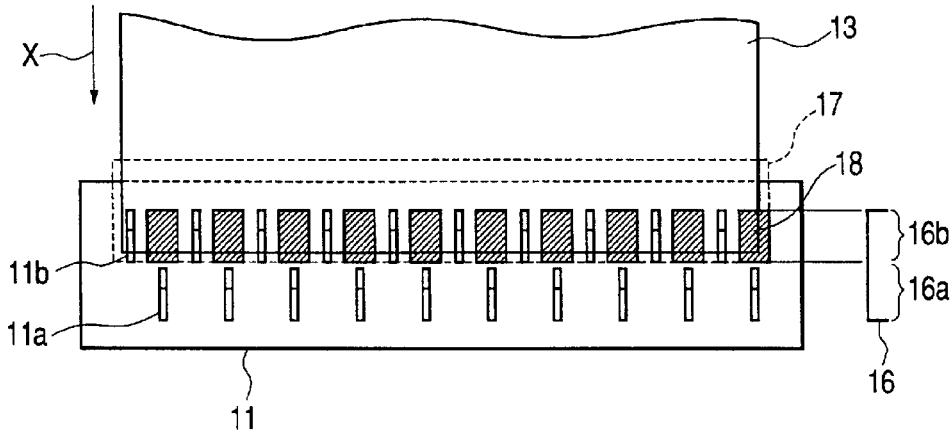
FIG. 6 is a schematic plan view showing a recording portion of a sheet leading end of the ink jet recording apparatus of the first embodiment of the invention.

Subsequently, processing for masking the second region (region indicated by a reference numeral 19 in FIG. 8) of the leading end recording data is carried out (step S3 in FIG. 2). This processing is for executing recording on the leading end by dividing it into a plurality of paths. FIG. 6 is a schematic plan view showing the method of masking the leading end recording data. In the drawing, a reference numeral 17 denotes the entire range of the leading end recording data; and 18 the first region of the leading end recording data.

In the masking of step S3, since only the first region 18 of the leading end recording data is recorded with respect to the leading end recording data 17 of one line, a remaining portion must be masked so as not to be recorded. That is, for example, AND is obtained from the leading end recording data fed in from the host computer, and the mask of the first region 18 of the leading end recording data, and only the recording data of a portion indicated by a hatched line in FIG. 6 is set as valid recording data.

Here, the first region 18 of the leading end recording data is set in correlation with the arrangement of the rib row provided in the platen 11. To explain this correlation with the arrangement of the rib row, a platen form will now be described.

Figure 7A:
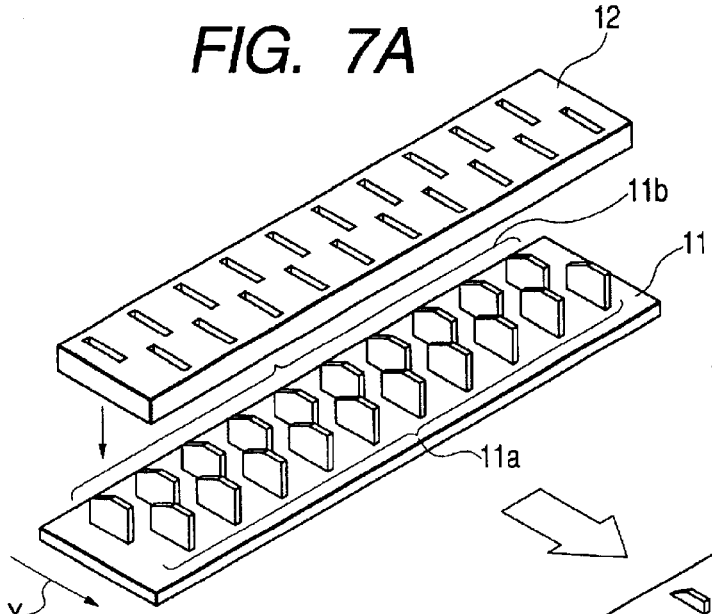
FIGS. 7A and 7B are schematic perspective views showing a platen portion of the ink jet recording apparatus of the first embodiment of the invention.
Figure 7B:
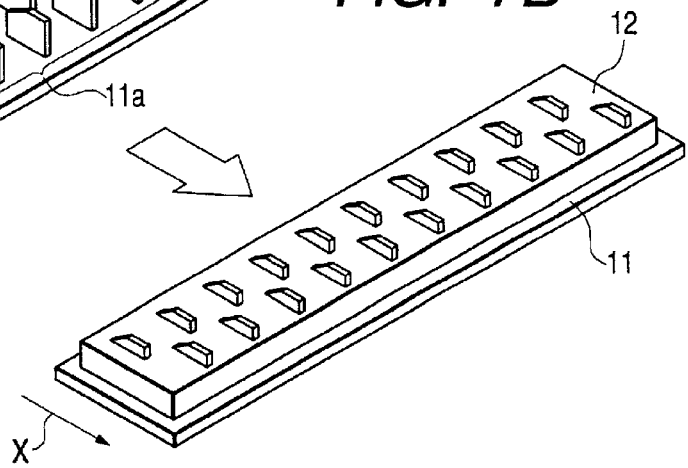

FIGS. 7A and 7B are schematic perspective views, each showing a relation between the platen 11 and the platen ink absorber 12. For the foregoing reason, the ribs are provided in the platen and, according to the invention, a plurality of rib rows are provided. As shown in FIGS. 3 to 7A, the platen 11 includes a platen rib row B 11*b* composed of ribs, which are arrayed roughly at equal intervals up to about half of the upstream side of the recording sheet conveying direction X, and a platen rib row A 11*a* composed of ribs, which are arrayed up to about half of the downstream side of the recording sheet conveying direction X such that each rib is disposed roughly in the center between the ribs of the platen rib row B 11*b*. In addition, when seen from the recording sheet conveying direction X, as shown in FIG. 4, the platen rib row B 11*b* is disposed up to about half of the upstream side of the discharge nozzle row 16, and the platen rib row A 11*a* is disposed up to about half of the downstream side of the discharge nozzle row 16.

In the platen 11 having such rib arrays, the platen ink absorber 12 is disposed in such a way as to fill portions other than the ribs. The platen ink absorber 12 is made of a material such as pulp or high polymer, having good ink absorbing efficiency, and has holes bored in portions corresponding to the ribs of the platen 11.

By combining the platen 11 with the platen ink absorber 12, a unit shown in FIG. 7B is formed, which is disposed in the recording apparatus.

On the platen 11 having the ribs disposed roughly in a staggered form as described above, the first region 18 of the leading end recording data is set in correspondence with the pitch of the platen rib row B 11*b* of the upstream side. More specifically, the first region 18 of the leading end recording data is set in such a way as to be disposed roughly in the center between the ribs of the platen rib row B 11*b* (FIG. 6). Accordingly, the pitch of the first region 18 of the leading end recording data substantially coincides with that of the platen rib row B 11*b*, and its width is about half of the pitch of the platen rib row B 11*b*.

The relation between the rib row of the platen 11 and the first region 18 of the leading end recording data has been described.

Figure 16:
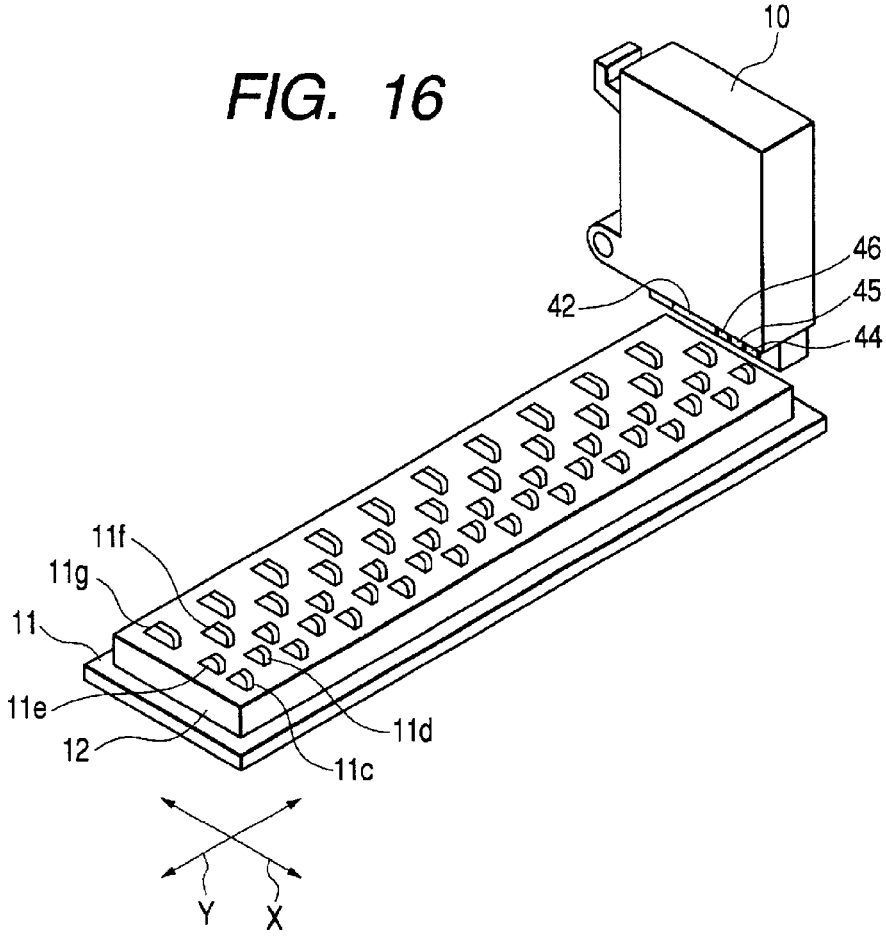
FIG. 16 is a schematic perspective view showing a platen portion of the ink jet recording apparatus of the second embodiment of the invention.

Subsequently, the first region 18 is scanned by the first scanning of the carriage 30 (step S4 of FIG. 2). Specifically, as described above, the carriage 30 is driven, and scanned, and the recording operation is preformed based on the masked recording data. Ink droplets discharged from the discharge nozzle of the recording head 10 land on the recording sheet 13 to be fixed. However, as shown in FIG. 4, since the discharge nozzle row 16*b* includes the discharge nozzle not facing the recording sheet 13 by the distance Lb, ink droplets discharged therefrom directly reach the platen ink absorber 12 to be absorbed and recovered. In addition, as shown in FIG. 16, for the recording of the first region 18, ink droplets are discharged from a portion having no platen rib row B 11*b*. Accordingly, no ink droplets are discharged onto the platen rib B 11*b*. Moreover, since the region that corresponds to the first region 18 of the leading end recording data is only that of the discharge nozzle row 16*b*, no ink droplets are discharged onto the platen rib row A 11*a*, and ink droplets discharged outside the recording sheet 13 are all absorbed and recovered by the platen ink absorber 12.

A reason for the discharging of no ink droplets on the ribs of the platen 11 by the foregoing method is as follows. That is, since the recording sheet 13 is conveyed while being guided by the ribs, the side opposite the recording surface side of the recording sheet 13 (the backside) and the ribs of the platen 11 relatively slide and, if there are ink droplets stuck on the ribs of the platen 11, the backside side of the recording sheet 13 may be stained by ink.

FIG. 3 shows a state after the end of the one-line recording operation. A first recording region 13*a* is formed on the recording sheet 13 by first scanning.

Subsequently, the recording sheet 13 is conveyed by a predetermined amount (step S5 of FIG. 2). By referring to FIG. 5, which shows a state after the conveyance of the recording sheet 13, it can be understood that the leading end portion of the recording sheet 13 after step S5 is located within the range of the discharge nozzle row 16*a*, and conveyed from the most downstream side of the discharge nozzle row 16*a* to the leading end of the recording sheet 13, away by a distance La. A reason for such a distance La is completely similar to that for the distance Lb described above with reference to FIG. 4. In addition, a conveying amount is preferably set equal to half or lower of a length of the discharge nozzle row 16 in the recording sheet conveying direction X. Thus, the length of the discharge nozzle length can be used highly efficiently.

Then, the first region 18 of the leading end recording data is masked (step S6 of FIG. 2). This masking is carried out for recording portions left unrecorded in the recording in steps S3 and S4.

Figure 8:
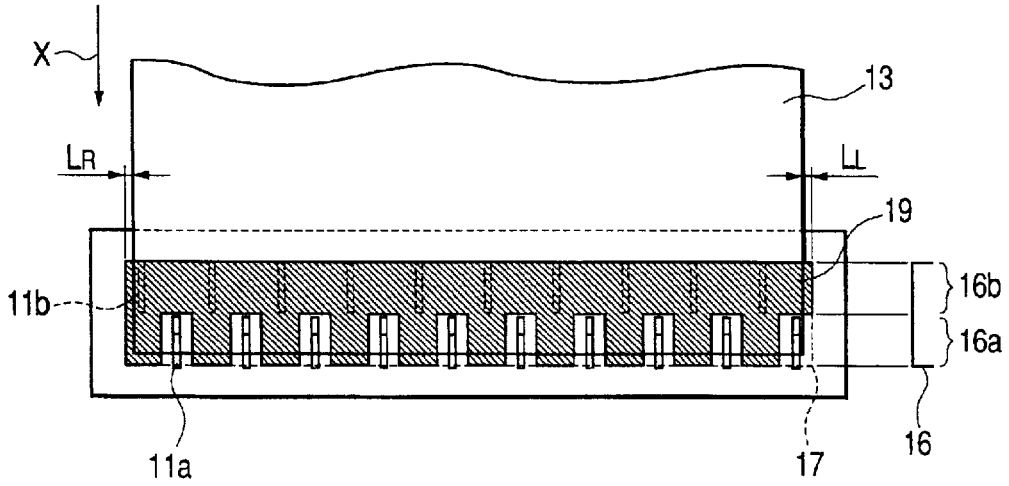
FIG. 8 is a schematic plan view showing the recording portion of the sheet leading end of the ink jet recording apparatus of the first embodiment of the invention.

FIG. 8 is a schematic plan view showing a second masking method of the leading end recording data. In the drawing, a reference numeral 19 denotes a second region of the leading end recording data. In the masking of step S6, since a portion left unrecorded in the masking of step S3 is recorded, the second region 19 of the leading end recording data is a region obtained by reversing (removing) the first region 18 of the leading end recording data with respect to the leading end recording data 17. As in the case of step S4, AND is obtained from the leading end recording data 17 and the mask of the second region 19 of the leading end recording data, and only recording data of a portion indicated by a hatched line in FIG. 8 is set as valid recording data.

Subsequently, the second region 19 is scanned by the second scanning of the carriage 30 (step S7 of FIG. 2). This scanning may be carried out by the first scanning during returning in step S4, or by returning to the start of the first scanning, and then scanning in the same direction as that for the first scanning. In this case, a portion of the valid recording data where ink droplets are discharged to the outside of the recording sheet 13 is between the ribs of the platen rib row A 11*a* because of a relation between the setting of the first region 18 of the leading end recording data and the platen rib rows A 11*a* and B 11*b*. Accordingly, no ink droplets are discharged onto the platen rib row A 11*a*. As a result, ink droplets discharged outside the recording sheet 13 are all absorbed and recovered by the platen ink absorber 12.

Figure 9:
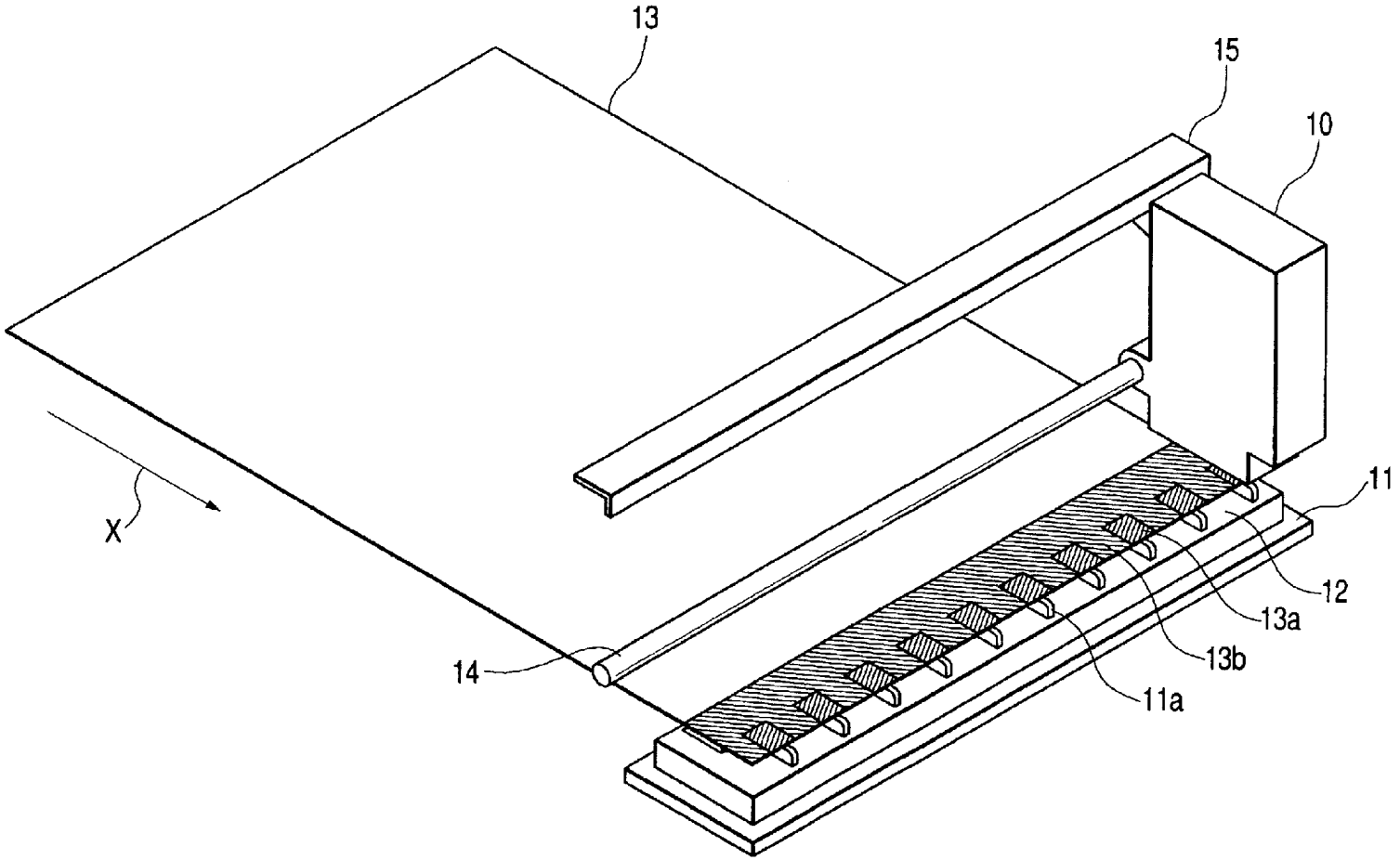
FIG. 9 is a schematic perspective view showing the recording unit of the ink jet recording apparatus of the first embodiment of the invention.

FIG. 9 shows a state after the end of the second scanning in the one-line recording operation. By forming a second recording region 13*b* on the recording sheet 13 by the second scanning, coupled with the first recording region 13*a*, one-line recording of the leading end recording data 17 is competed.

The method of recording with no blank spaces in the leading end of the sheet has been described.

In the foregoing, the description was made particularly of the recording with no blank spaces (recording with no margins) in the leading end portion of the recording sheet 13. In FIGS. 3, 6, 8 and 9 referenced above, recording is also made simultaneously with no blank spaces in the left and right ends, and thus this recording will be described.

Regarding recording with no blank spaces (recording with no margins) in the left and right ends of the recording sheet 13, if the carriage scanning direction positions of the recording sheet 13 and the carriage 30 are in ideal states, it is possible to perform recording with no blank spaces by executing recording to the limit of the sheet end.

In an actual case, however, because of dependence on the sheet setting accuracy or the like in the left and right directions by the user, ideal states are frequently far from being realized. To avoid such a problem, means can be taken to perform recording by using a sensor or the like to detect the left/right end position of the recording sheet 13. However, such means is not advisable if consideration is given to costs. Thus, by setting a real recording region width equal to/higher than the width of the recording sheet 13, it is realistic to perform recording with no blank spaces (recording with no margins) by discharging some ink droplets to the outside of the recording sheet 13. This system is also employed in the described embodiment.

Specifically, recording data is set to be wider than the set size of the recording sheet 13 by amounts LL and LR shown in FIG. 8. In the regions of LL and LR, the arrangements of the rib rows are predetermined so as to prevent the presence of ribs on the platen 11. This constitution prevents the sticking of ink droplets on the ribs of the platen 11 even if ink droplets are discharged outside the left or right end of the recording sheet, thereby enabling recording with no blank spaces (recording with no margins) to be performed. In addition, as recording data, it is necessary to prepare data having a length, which is obtained by adding LL and LR to the width of the recording sheet 13. In the case of this constitution, when a recording sheet having an unknown sheet width is inserted, although ink droplets may be stuck to the ribs of the platen 11, the sheets of standardized sizes are used in most cases, and thus there are no problems for practical purposes.

Figure 10:
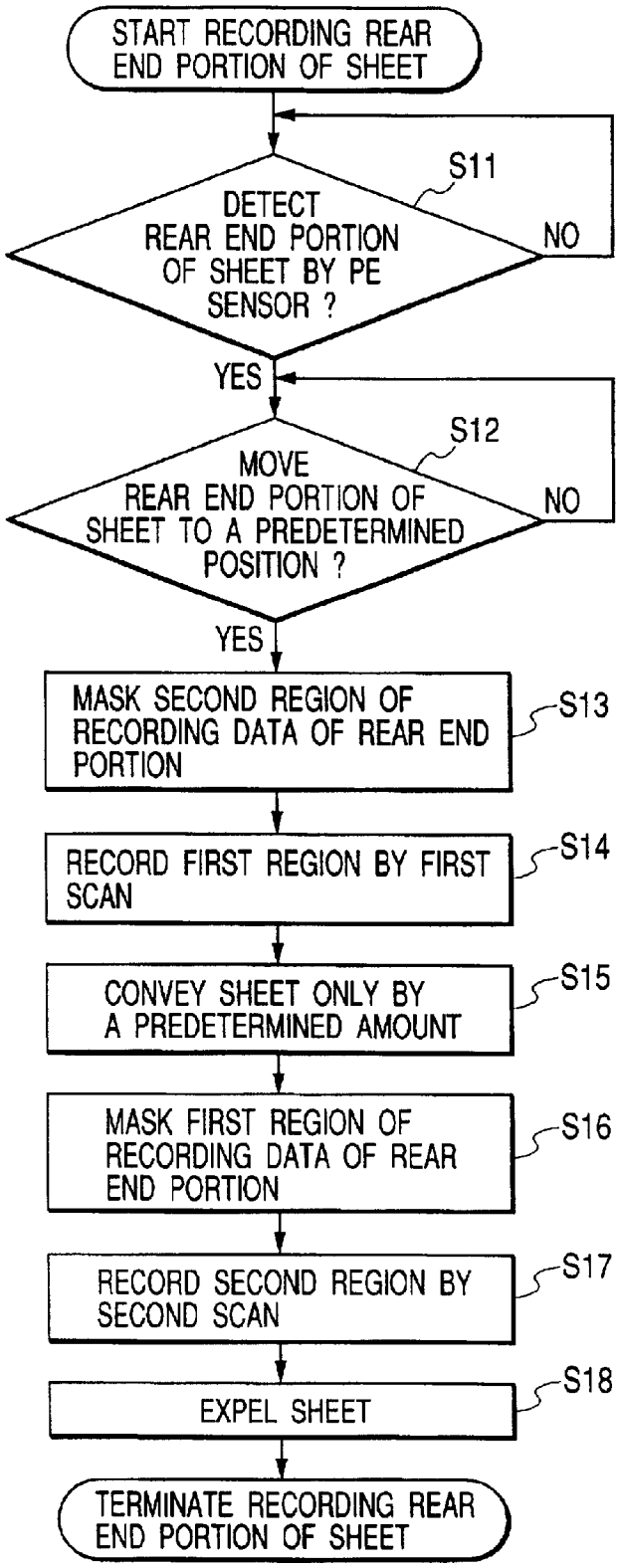
FIG. 10 is a flowchart schematically showing a recording operation of the ink jet recording apparatus of the first embodiment of the invention.

Next, description will be made of recording with no blank spaces (recording with no margins) in the rear end portion of the sheet by referring to the flowchart of FIG. 10 illustrating the recording operation of the rear end portion of the sheet.

When the rear end of the recording sheet 13 being conveyed is detected by a not-shown paper end (PE) sensor, a recording operation is started on the rear end portion of the sheet (step S11 of FIG. 10). During the recording operation on the full surface of the sheet, the rear end portion of the recording sheet 13 is detected during the recording sheet conveyance in the middle of the recording operation, and thus the position of detecting the sheet rear end is stored in the memory of the control circuit for the recording apparatus.

Then, determination is made as to the conveyance of the recording sheet 13 by a predetermined amount from the recording sheet rear end position previously detected and stored in the memory (step S12 of FIG. 10). Specifically, determination is made as to whether the rear end portion of the recording sheet 13 is in the range of the discharge nozzle row 16*b* or not. If the sheet rear end is determined to be in this range, then the process proceeds to the next step.

Subsequently, the second region of the rear end recording data (region indicated by a reference numeral 29 in FIG. 14) is masked (step S13 of FIG. 10). Specific means is almost similar to that of the recording with no blank spaces in the sheet leading end, and thus only brief description will be made. That is, the recording data to be masked in this step is one located in the place of the same phase as that for the platen rib row B 11*b* (FIG. 12).

Also for the recording end portion, it is necessary to prepare recording data having a length longer than that of the recording sheet 13 by foreseeing ink droplets to be discharged to the outside of the recording sheet 13.

Figure 11:
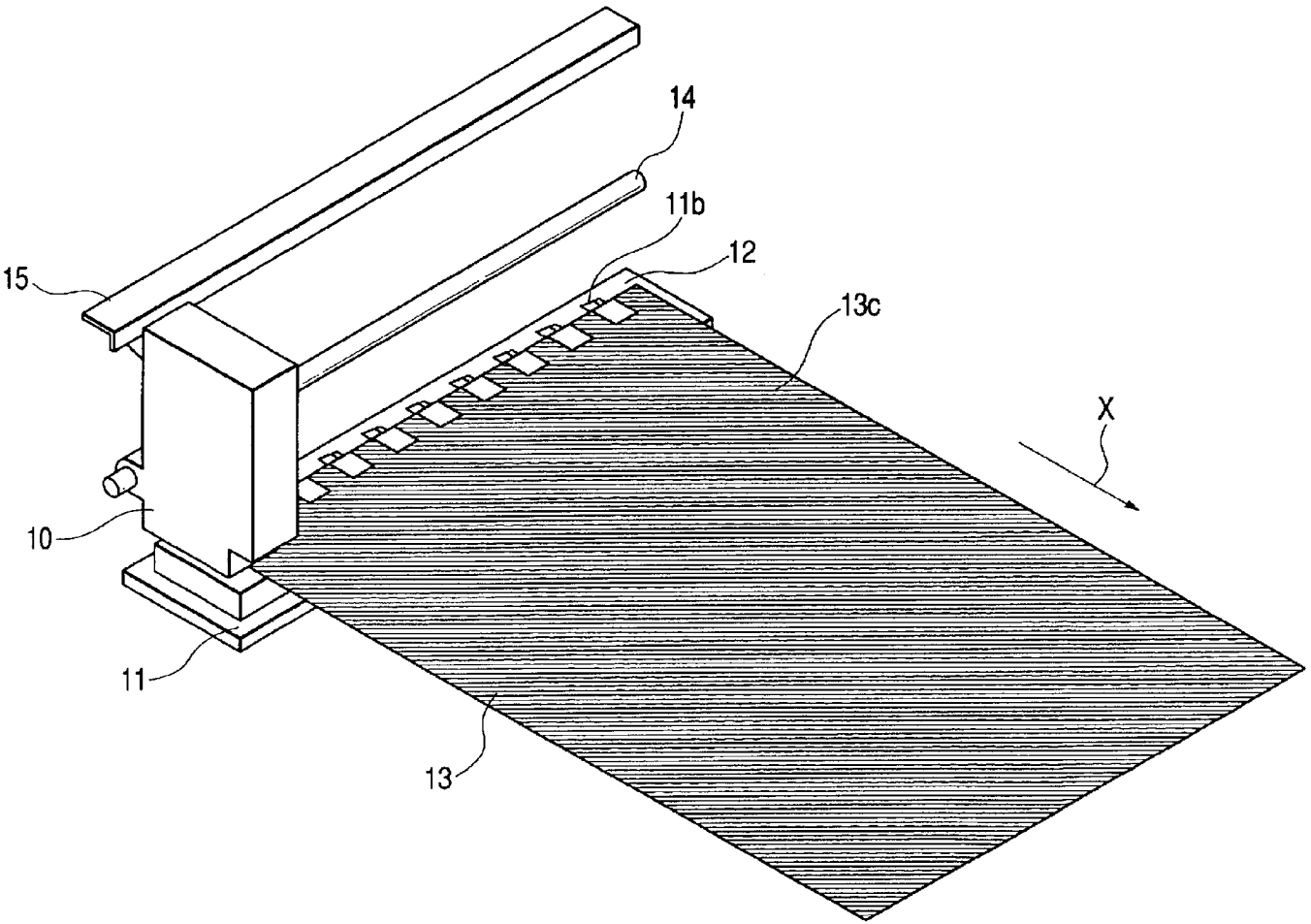
FIG. 11 is a schematic perspective view showing the recording unit of the ink jet recording apparatus of the first embodiment of the invention.

Then, a first region 28 is recorded by the first scanning of the carriage 30 (step S14 of FIG. 10). The recording operation is similar to that for the recording with no blank spaces in the sheet leading end (see FIG. 12). Thus, the sticking of ink droplets onto the platen rib row B 11*b* is prevented, and ink droplets discharged to the outside of the recording sheet 13 are directly absorbed and recovered by the platen ink absorber 12. FIG. 11 shows a state after the end of this recording operation of one line. As indicated by a hatched line, an integrated recording region 13*c* is formed by integrating the region recorded before the sheet rear end recording with the first recording region by the first scanning on the recording sheet 13.

Figure 14:
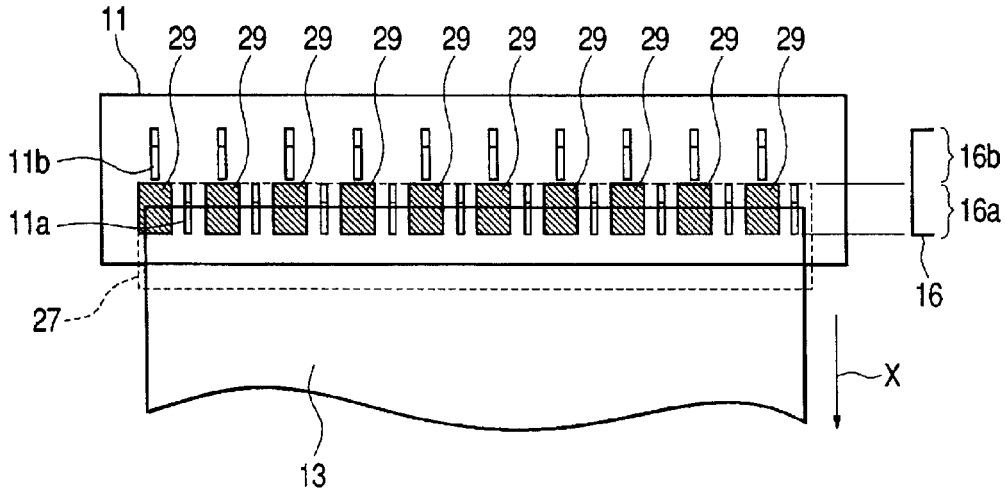
FIG. 14 is a schematic plan view showing the recording portion of the sheet leading end of the ink jet recording apparatus of the first embodiment of the invention.

Subsequently, the recording sheet 13 is conveyed by a predetermined amount (step S15 of FIG. 10). The rear end of the recording sheet 13 after the conveyance by the predetermined amount is within the range of the discharge nozzle row 16*a* as shown in FIG. 14, and the amount of conveyance in this case should preferably be set equal to/lower than half of the length of the discharge nozzle row 16 in the recording sheet conveying direction X.

Then, the first region 28 of the rear end recording data is masked (step S16 of FIG. 10). This masking is carried out for recording a portion unrecorded in steps S13 and S14. In other words, the recording data to be masked in this step is data located in the place of the same phase as that for the platen rib row A11a (FIG. 14).

Figure 13:
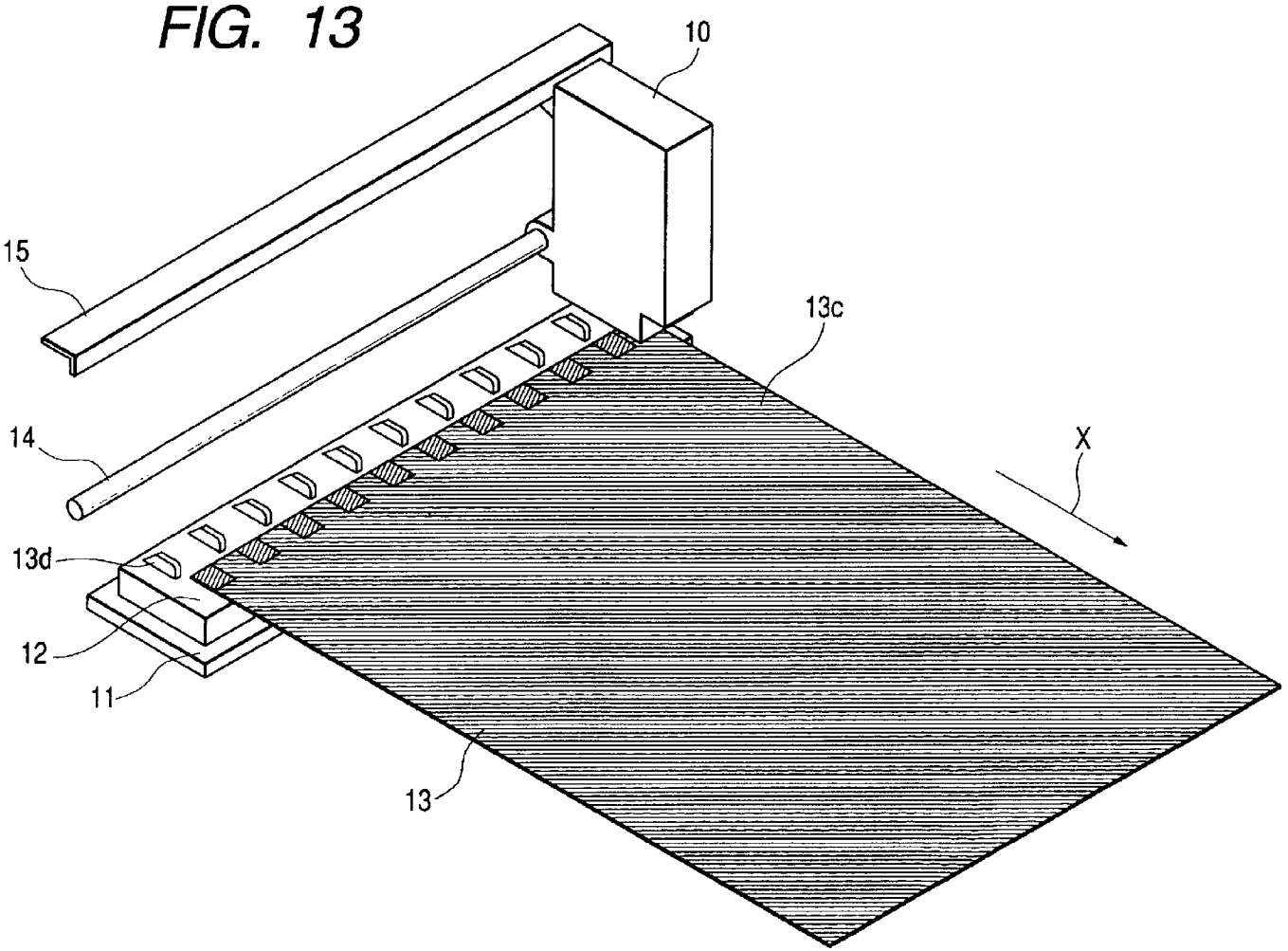
FIG. 13 is a schematic perspective view showing the recording unit of the ink jet recording apparatus of the first embodiment of the invention.

Then, a second region 29 is recorded by the second scanning of the carriage 30 (step S17 of FIG. 10). The recording operation is similar to that for recording with no blank spaces (recording with no margins) in the sheet leading end (see FIG. 14). Thus, the sticking of ink droplets onto the platen rib row A 11*a* is prevented, and ink droplets discharged to the outside of the recording sheet 13 are directly absorbed and recovered by the platen ink absorber 12. FIG. 13 shows a state after the end of the recording operation of one line, where the integrated recording region 13*c* already recorded by step S14 is integrated with a last recording region 13*d* recorded in step S17, thereby completing the recording on the full surface of the recording sheet 13.

Then, the recording sheet 13 is expelled out of the recording apparatus (step S18 of FIG. 10). The expelling operation is carried out cooperatively by the discharge roller 37 and the not-shown gear as described above.

The method of recording with no blank spaces in the sheet rear end portion has been described.

Therefore, since recording with no blank spaces in the leading end, in the left and right ends, and in the rear end can be performed, it is possible to carry out recording with no blank spaces on the full surface of a predetermined recording sheet.

In the embodiment, the ribs of the platen rib row are arrayed at equal intervals. However, the invention is not limited to such an arrangement, and the ribs may be arranged at ununiform intervals.

In such a case, each rib of the platen rib row A 11*a* may be disposed between the adjacent ribs of the platen rib row B 11*b* or roughly in the center, the first and second regions 18 and 19 of the leading end recording data may respectively be set between the ribs of the platen rib rows B 11*b* and A 11*a* or roughly in the centers, and a width of each in this case may be set about half of the rib interval.

In the embodiment, the one-line recording/feeding was carried out by a width equivalent to nearly ½ of the length of the discharge nozzle row 16 during the recording of the sheet leading end portion or the sheet rear end portion. However, the invention is not limited to such, and one-line recording/feeding may be carried out by a length equal to/lower than ½ of the length of the discharge nozzle row 16. This is very effective in that especially when wishing to obtain recording resolution equal to/higher than the real resolution of the discharge nozzle row or the like, it can be realized by recording the same region in an interlacing manner by a plurality of line-feeding operations.

In addition, in the embodiment, the width of the discharge nozzle row 16 was divided into the two portions, i.e., the place indicated by the reference numeral 16*a*: the place indicated by the reference numeral 16*b*≅1:1. However, the invention is not limited to such, and the width may be divided into three or more portions, or an ununiform division ratio may be set.

As apparent from the foregoing, by constructing the ink jet recording apparatus according to the embodiment, it is possible to perform recording on the full surface of the recording sheet with no blank spaces without any complication or enlargement of the recording apparatus, and without any cost increases. To obtain a recording result with no blank spaces, it is not necessary for the user himself to perform secondary processing after the recording operation, thus improving operability. Moreover, since no secondary processing is necessary for the recording sheet after the recording operation to obtain a recording result with no blank spaces, it is possible to obtain a very beautiful recording result without any degradation of recording sheet finishing.

Second Embodiment

In the foregoing first embodiment, the case of only one discharge nozzle row of the recording head was shown. However, the invention is not limited to such a case, and it can be applied to a case where the recording head includes a plurality of discharge nozzle rows.

In the section, the second embodiment will be described with reference to the accompanying drawings. Here, the description will focus on points different from the first embodiment.

Figure 15A:
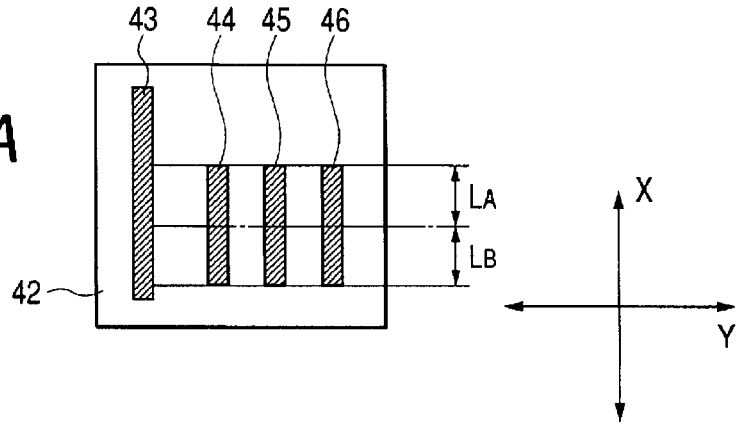
FIGS. 15A, 15B and 15C are schematic plan views, each showing a discharge nozzle row of an ink jet recording apparatus according to a second embodiment of the invention.
Figure 15B:
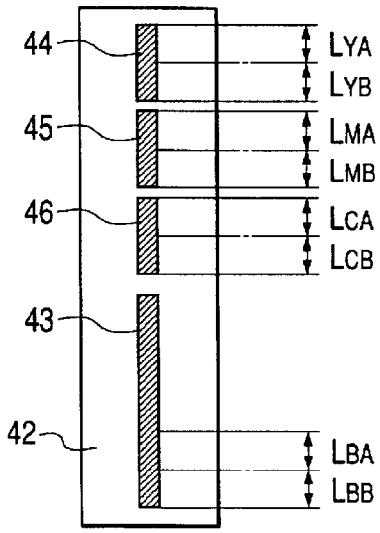
Figure 15C:
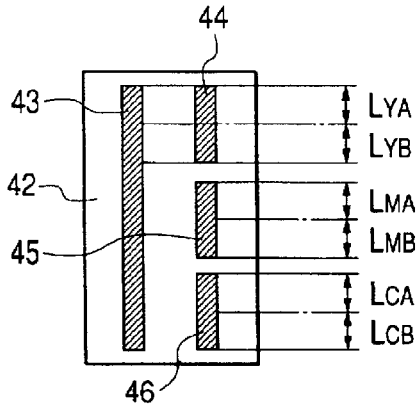

FIGS. 15A to 15C are schematic plan views, each showing the discharge nozzle face of a recording head including a plurality of discharge nozzle rows. In the drawings, a reference numeral 42 denotes the discharge nozzle face of the recording head when seen from the recording sheet side; 43 the discharge nozzle row B of black ink; 44 the discharge nozzle row Y of yellow ink; 45 the discharge nozzle row M of magenta ink; and 46 the discharge nozzle row C of cyan ink. The upper and lower direction of FIG. 13 is a recording sheet conveying direction X, and a left and right direction with respect to the sheet surface is a carriage scanning direction Y.

First, description will be made of a case where a plurality of discharge nozzle rows are arrayed in a horizontal direction (roughly parallel to the carriage scanning direction).

FIG. 15A shows an example of the case where the plurality of discharge nozzle rows are arrayed in the horizontal direction. In this case, a recording process regarding recording with no blank spaces (recording with no margins) in the leading end and the rear end is substantially similar to that of the first embodiment. However, when recording from all the discharge nozzles is carried out by one scanning of the carriage, it is advisable to perform sheet conveyance control in such a way as to position the leading end or the rear end of the recording sheet in a region described below. That is, a region where the plurality of discharge nozzle rows B, Y and C are present in common in the recording sheet conveying direction is treated equally to the discharge nozzle row 16 region (see FIGS. 5, 8, etc.) of the first embodiment. This common region is divided into two portions roughly at the center thereof, and these portions are set as nozzle rows A and B. In addition, a rib row disposed on the platen is also divided into two rows roughly at the center of the common region.

With the foregoing constitution, when the leading end or the rear end portion of the recording sheet is recorded, sheet conveyance control is performed such that the end portions stop at least once each in the regions LA and LB. Thus, it is possible to perform recording with no blank spaces on the full surfaces of the recording sheet.

Next, description will be made of a case where a plurality of nozzle rows are arrayed in a longitudinal direction (straight line along the sheet conveying direction).

FIG. 15B shows an example where the plurality of nozzle rows are arrayed in the longitudinal direction. In this case, sheet conveyance control and the rib row arrangement of the platen become a little complex. That is, in the case of the sheet conveyance control, the control described above with reference to the first embodiment is carried out for each discharge nozzle row, and the control is repeated according to the number of discharge nozzle rows. Specifically, a discharge nozzle row B 43 is divided into regions LBA and LBB; a discharge nozzle row C 46 into regions LCA and LCB; a discharge nozzle row M 45 into regions LMA and LMB; and a discharge nozzle row Y 44 into regions LYA and LYB.

The rib row disposed on the platen may also be divided roughly at the center of each discharge nozzle row. According to the embodiment, the rib row of the platen can be divided into five by setting common the divided regions of the adjacent discharge nozzle rows.

FIG. 16 shows an example of the rib row of the platen, which is divided into five. In the drawing, reference numerals 11*c*, 11*d*, 11*e*, 11*f*, and 11*g* respectively denote platen rib rows C, D, E, F and G.

In the embodiment, the region of the discharge nozzle row B 43 is not divided at the center. The region division can be made somewhere in the discharge nozzle row, and it is not always divided at the center. The same can be said of the division of the rib row of the platen. With the foregoing constitution, when the leading end or the rear end portion of the recording sheet is recorded, it is advisable to perform sheet conveyance control such that the end portion stops at least once each in the divided regions LBB, LBA, LCB, LCA, LMB, LMA, LYB and LYA of the discharge nozzle row. Accordingly, it is possible to perform recording with no blank spaces on the full surface of the recording sheet.

Next, description will be made of a case where a plurality of nozzle rows are partially arrayed in longitudinal and horizontal directions. FIG. 15C shows an example where the plurality of discharge nozzle rows are arrayed in the longitudinal and horizontal directions. In this case, the arrangement is basically similar to the longitudinal array of FIG. 15B. Specifically, the discharge nozzle row C 46 is divided into regions LAC and LCB; the discharge nozzle row M 45 into regions LMA and LMB; and the discharge nozzle row Y 44 into regions LYA and LYB. The discharge nozzle row B 43 should preferably be divided at the same phase as that for the dividing position of any one of the discharge nozzle rows arrayed in the horizontal direction.

In addition, regarding the rib rows of the platen, division may be made roughly at the center of each of the discharge nozzle rows Y 44, M 45, and C 46. According to the embodiment, the number of ribs of the platen can be set to four by making common the divided regions of the adjacent discharge nozzle rows.

With the foregoing constitution, when the leading end or the rear end portion of the recording sheet is recorded, it is advisable to perform sheet conveyance control such that the sheet end portions stop at least once in each of the regions LCB, LCA, LMB, LMA, LYB and LYA. Accordingly, it is possible to perform recording with no blank spaces on the full surface of the recording sheet.

As apparent from the foregoing, with the ink jet recording apparatus constructed according to the embodiment, even in the case of the recording head including the plurality of discharge nozzle rows, it is possible to perform recording with no blank spaces on the full surface of the recording sheet without any complication or enlargement of the recording apparatus, and without any cost increases.

Figure 17:
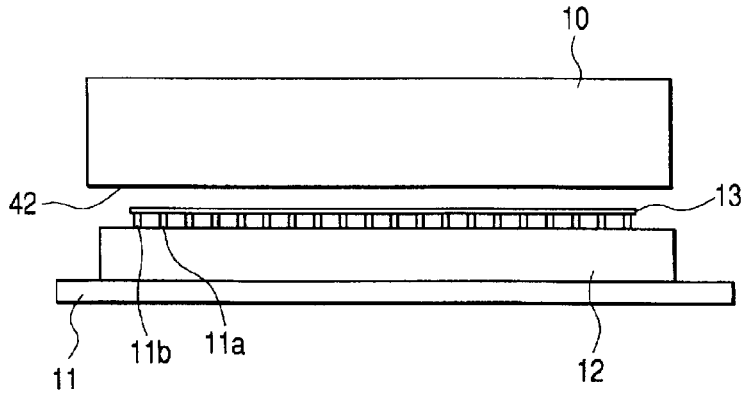
FIG. 17 is a view showing an ink jet recording method of the invention, seen from a conveying direction of a recording medium, when the method is applied to a recording head of a full-line type.

In the foregoing first and second embodiments, reference was made to the example of the so-called serial type recording apparatus, which performs recording by conveying the recording medium, and scanning the recording head in the direction intersecting the recording medium conveying direction. However, the invention is not limited to such, and it can be applied to a so-called full line type recording apparatus, in which the recording head includes a discharge port row corresponding to the full width of the recording medium. For example, as shown in FIG. 17 of the recording apparatus of the invention seen from the recording medium conveying direction, even if the recording head 10 of the serial type shown in FIGS. 3, 9, 11, 13, etc., is changed to the recording head of the full line type, it is possible to execute a recording method similar to that described above with reference to each of the embodiments.

Further, the invention can also be applied to a recording apparatus, in which instead of the recording head of the full line type limited to a single color, a plurality of full line type recording heads independent for individual colors are provided in the recording medium conveying direction, and image recording of a plurality of colors, e.g., magenta, cyan, yellow, black, etc., can be performed.

As apparent from the foregoing, according to each of the embodiments, it is possible to perform recording with no blank spaces on the full surface of the recording medium without any complication or enlargement of the recording apparatus, and without any cost increases.

In addition, since it is not necessary for the user himself to perform any secondary processing after the recording operation to obtain a recording result with no blank spaces, operability can be improved.

Moreover, since it is not necessary to add any secondary processing of the recording medium after the recording operation to obtain a recording result with no blank spaces, it is possible to obtain a very beautiful recording result without any degradation of recording medium finishing.

Third Embodiment

Next, detailed description will be made of another embodiment regarding a recording method, especially a method of recording on the leading end and the rear end portions of the recording sheet 13, by referring to FIGS. 18 to 25.

Figure 24:
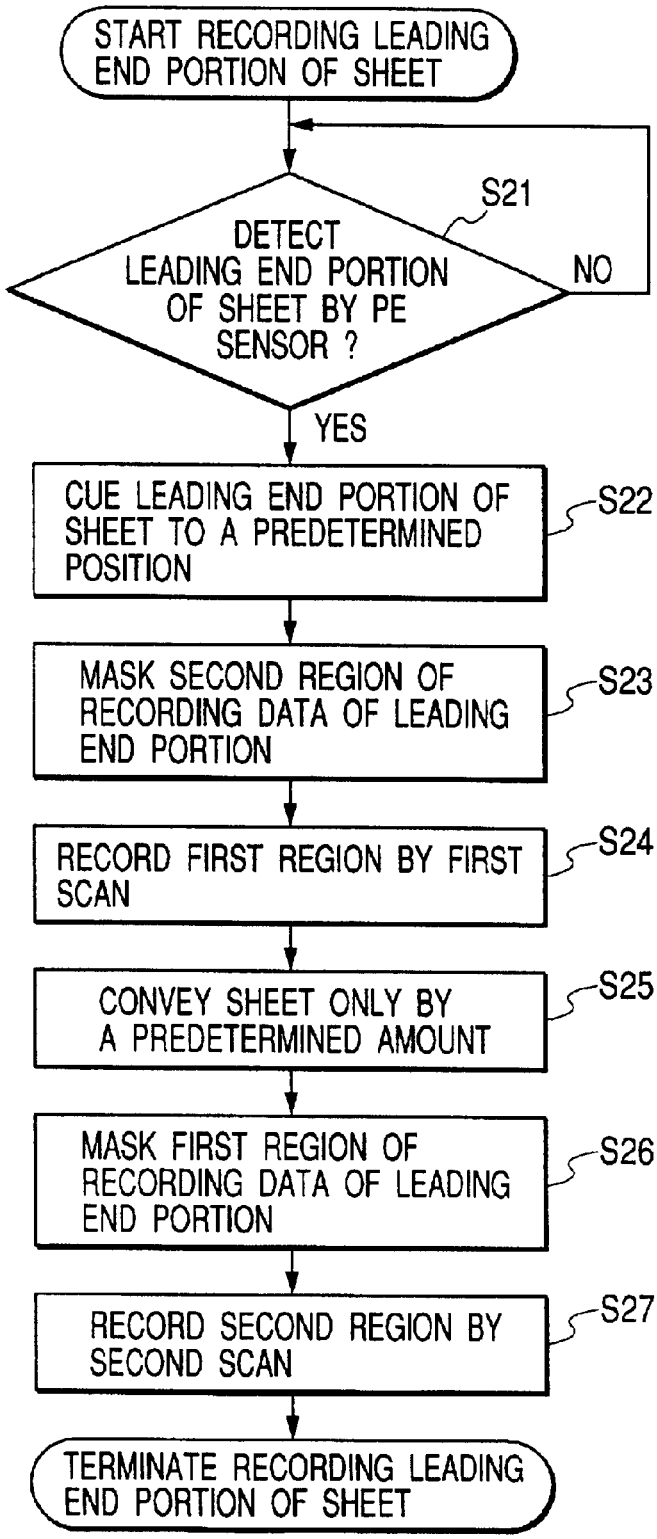
FIG. 24 is a flowchart schematically showing a recording operation of the ink jet recording apparatus of the third embodiment of the invention.

First, description will be made of recording with no blank spaces in the leading end portion of the sheet by referring to the flowchart of FIG. 24 illustrating the recording operation on the leading end portion of the sheet.

In step S21, when the leading end of the recording sheet is detected by a not-shown paper end (PE) sensor, a recording operation on the leading end of the sheet is started.

Then, in next step S22, to cue the leading end of the recording sheet 13 to a predetermined position, the LF motor is driven to rotate the LF roller forward. The predetermined position means a position satisfying a relation between the recording head 10 and the recording sheet 13 shown in FIG. 18. Here, to clarify a positional relation, FIG. 4 shows a schematic side view of the recording apparatus when seen from the side of FIG. 1. In the drawing, a reference numeral 16 denotes an ink discharge nozzle row provided in the recording head 10. The discharge nozzle row 16 includes a plurality of nozzles arrayed roughly linearly, and roughly a half of the upstream side thereof in a sheet conveying direction is called a discharge nozzle row 16*b*. Similarly, as shown in FIG. 5, roughly a half of the downstream side thereof in the sheet conveying direction is called a discharge nozzle row 16*a*.

The predetermined position for cuing during the recording operation on the leading end of the sheet indicates a state, where the leading end of the recording sheet 13 is within the range of the discharge nozzle row 16*b*, and located before the most downstream side of the discharge nozzle row 16*b* by a distance Lb. A reason for setting such a distance Lb is as follows. That is, if the conveying of the recording sheet is in an ideal state, and the relative positions of the leading end of the recording sheet 13 and the discharge nozzle of the recording head 10 can be established, then by starting the recording operation from the head portion of the recording sheet 13 with Lb=0, it is possible to perform recording with no blank spaces in the leading end. In actuality, however, there may be a shortage of accuracy of the PE sensor for detecting the position of the recording sheet, or there may be a loss of parallelism between the leading end part of the recording sheet and the scanning direction of the carriage 30 caused by the slightly oblique conveying of the recording sheet 13. Thus, with Lb=0, small blank spaces may be generated in the leading end, or unexpected discharging of ink droplets to the outside of the recording sheet may occur. It is not impossible to devise means for completely preventing such a problem, but it is not advisable to adopt such means because of cost consideration. As described above, by setting a proper distance Lb, even if certain variance occurs in various accuracies, it is possible to assure that the leading end of the recording sheet 13 is always in the region of the discharge nozzle row 16*b*. Thus, no blank spaces are generated in the leading end.

In the described case, data necessary for recording must be foreseen, including one regarding the distance Lb. In actual practice, therefore, it is necessary to prepare data of a region slightly larger than that to be recorded on the recording sheet. After the end of the cuing of the recording sheet carried out in the foregoing manner, a recording operation is started in the next step.

Subsequently, in step S23, processing for masking the second region of the leading end recording data is carried out. This processing is for executing recording on the leading end by dividing it into a plurality of paths.

Figure 22:
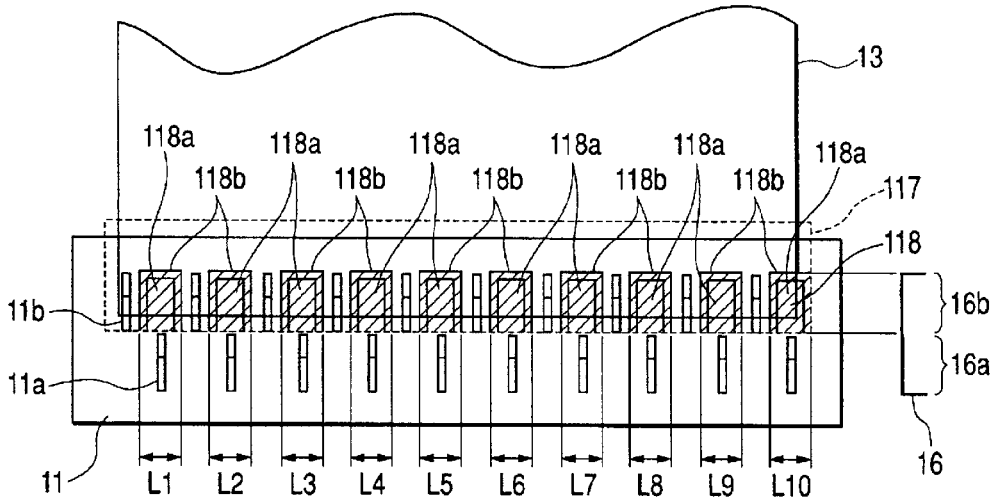
FIG. 22 is a schematic plan view showing a recording portion of the ink jet recording apparatus of the third embodiment of the invention.

FIG. 22 is a schematic plan view showing the method of masking the leading end recording data. In the drawing, a reference numeral 117 denotes the entire range of the leading end recording data; and 118 the first region of the leading end recording data. The data first region 118 is composed of a first region signal portion 118*a* not superposed by a later-described second region of the leading end recording data, and a first region superposed portion 118*b* superposed by the second region of the leading end recording data.

In the masking of step S23, since only the first region 118 of the leading end recording data is recorded with respect to the leading end recording data 117 of one line, a remaining portion must be masked so as not to be recorded. That is, AND is taken from the leading end recording data fed in from the host computer or the like, and the mask of the first region 18 of the leading end recording data, and only the recording data of a portion indicated by a hatched line in FIG. 22 is set as valid recording data.

Here, original 100% of the recording data of the first region single portion 118*a* is recorded, while the first region superposed portion 118*b* is processed by using a random mask pattern. This is attributed to the fact that as described later, since the first and second regions 118 and 119 of the leading end recording data are recorded during the scanning of different recording heads 10, in the boundary thereof, a small gap may occur because dots formed by ink droplets are not filled, i.e., so-called white line, or conversely the landing of ink droplets on the same plate may occur, i.e., black line. The occurrence of such a white or black line depends on the conveying accuracy of the carriage 30, the conveying accuracy of the recording sheet 13, the form of the recording sheet, etc., it is very difficult to reduce the occurrence to zero. As a technology for reducing visual influence on the recording result by such an error, random masking is carried out. This technology makes use of a visual characteristic that gaps or superposing occurring in a random position are difficult to be seen by human eyes, while dot gaps or superposing arrayed on a straight line are easily seen by human eyes.

Figure 26:
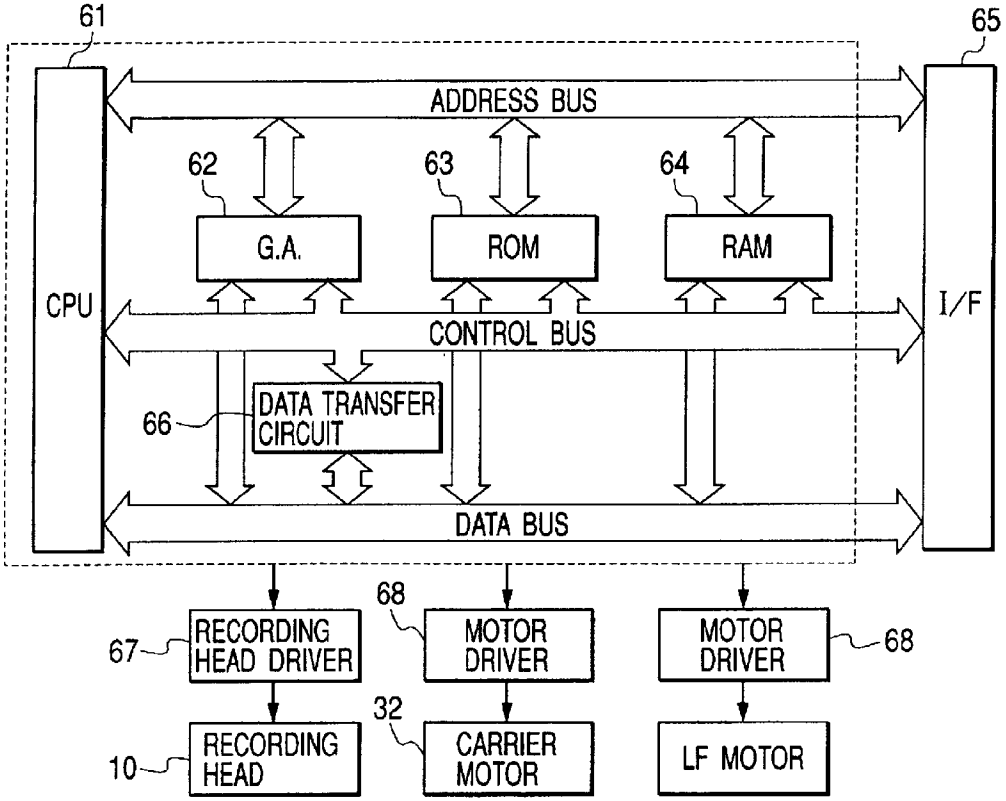
FIG. 26 is a schematic block diagram showing a control unit of the ink jet recording apparatus of the third embodiment of the invention.

Next, description will be made of specific means of random masking. FIG. 26 is a block diagram showing the electric circuit rigidity of the ink jet recording apparatus of the invention; and FIGS. 27A and 27B examples of 4×4 dot random access patterns. In the embodiment, a pattern of 50% duty is first used, and then a complementary pattern of 50% is used, thus obtaining a 100% recording duty at the end. This duty distribution may be optionally set as long as a total result is 100% at the end. For pattern generation, a method of generation by using random numbers may be used as occasion demands. Alternatively, patterns may be stored beforehand in a ROM 63 or a RAM 64, and one may be selected to be used.

Figure 27B:
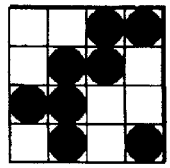
FIGS. 27A and 27B are schematic views, each showing a mask pattern of the ink jet recording apparatus of the third embodiment of the invention.
Figure 27A:
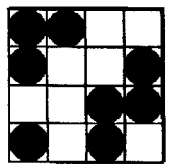

When the first region superposed portion 118*b* is recorded, one shown in FIG. 27A is used as a random mask pattern. AND is taken between a place indicated by a black circle in the drawing and the recording data to be set as discharge data, and this data is transferred through a data transfer circuit 66 to a recording head driver 67.

Here, the first region 118 of the leading end recording data is set as data having a block form synchronized with the arrangement of the rib rows provided in the platen 11. To explain how a data block is formed in synchronization with the arrangement of the rib rows, the platen form will be described next.

FIGS. 7A and 7B are schematic perspective views, each showing a relation between the platen 11 and the platen ink absorber 12. For the foregoing reason, the ribs are provided in the platen and, according to the invention, a plurality of rib rows are provided. As shown in FIG. 7A, the platen 11 includes a platen rib row 11*b* composed of ribs, which are arrayed roughly at equal intervals up to about half of the upstream side of the recording sheet conveying direction, and a platen rib row 11*a* composed of ribs, which are arrayed up to about half of the downstream side of the recording sheet conveying direction such that each rib is disposed roughly in the center between the ribs of the platen rib row 11*b*. In addition, as shown in FIG. 5, the platen rib row 11*b* is disposed up to about half of the upstream side of the discharge nozzle row 16, and the platen rib row 11*a* is disposed up to about half of the downstream side of the discharge nozzle row 16. In the platen 11 having such rib arrays, the platen ink absorber 12 is disposed in such a way as to fill portions other than the ribs.

The platen ink absorber 12 is made of a material such as pulp or high polymer, having good ink absorbing efficiency, and has holes bored in portions corresponding to the ribs of the platen 11. By combining the platen 11 with the platen ink absorber 12, a unit shown in FIG. 7B is formed, which is disposed in the recording apparatus.

On the platen 11 having the ribs disposed roughly in a staggered form as described above, the first region 118 of the leading end recording data is set in correspondence with the pitch of the platen rib row 11*b* of the upstream side. More specifically, the first region 118 of the leading end recording data is set in such a way as to be disposed roughly in the center between the ribs of the platen rib row 11*b*. Accordingly, the pitch of the first region 118 of the leading end recording data substantially coincides with that of the platen rib row 11*b*, and its width is about half of the pitch of the platen rib row 11*b*.

The relation between the rib row of the platen 11 and the first region 118 of the leading end recording data has been described.

Subsequently, in step S24, the first region is scanned by the first scanning of the carriage 30. Specifically, as described above, the carriage 30 is driven, and scanned, and the recording operation is performed based on the masked recording data. Ink droplets discharged from the discharge nozzle of the recording head 10 land on the recording sheet 13 to be fixed. However, as shown in FIG. 4, since the discharge nozzle row 16*b* includes the discharge nozzle not facing the recording sheet 13 by the distance Lb, ink droplets discharged therefrom directly reach the platen ink absorber 12 to be absorbed and recovered. In addition, for the recording of the first region, ink droplets are discharged only from a portion having no platen rib row 11*b*. Accordingly, no ink droplets are discharged onto the platen rib row 11*b*. Moreover, as shown in FIG. 22, since the region that corresponds to the first region of the leading end recording data is only that of the discharge nozzle row 16*b*, no ink droplets are discharged onto the platen rib row 11*a*, and ink droplets discharged outside the recording sheet 13 are all absorbed and recovered by the platen ink absorber 12.

A reason for the discharging of no ink droplets on the ribs of the platen 11 by the foregoing method is as follows.

That is, since the recording sheet 13 is conveyed while being guided by the ribs, the opposite recording surface side of the backside of the recording sheet 13, and the ribs of the platen 11 slide relatively and, if there are ink droplets stuck on the ribs of the platen 11, the opposite recording surface side of the recording sheet 13 may be stained by ink.

Figure 18:
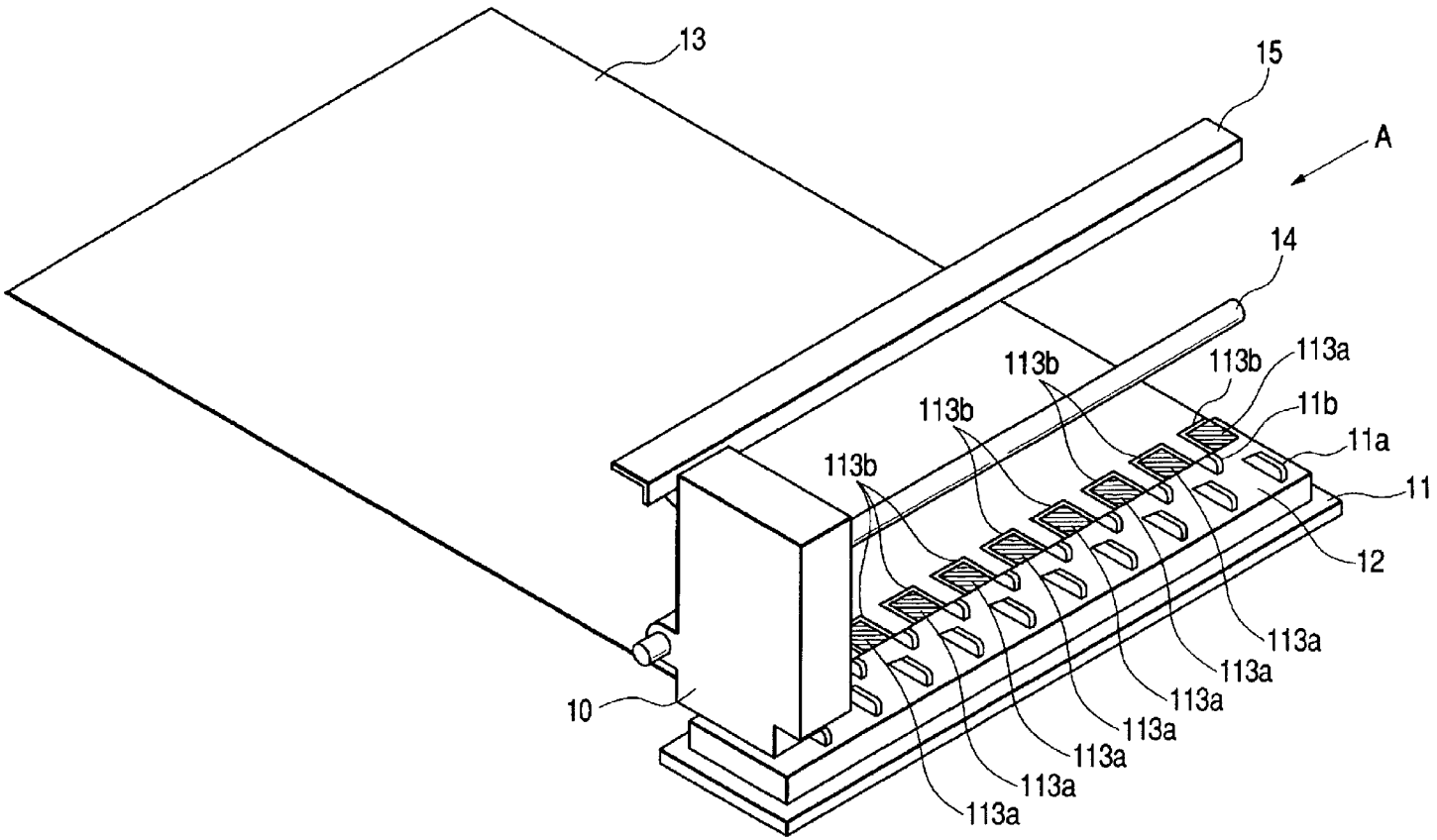
FIG. 18 is a schematic perspective view showing a recording unit of an ink jet recording apparatus according to a third embodiment of the invention.

FIG. 18 shows a state after the end of the one-line recording operation. A first recording region 13*a* is formed on the recording sheet 13 by first scanning.

Subsequently, in step S25, the recording sheet 13 is conveyed by a predetermined amount. FIG. 5 shows a state after the conveyance of the recording sheet 13. In this case, the leading end portion of the recording sheet 13 is located within the range of the discharge nozzle row 16*a*, and conveyed from the most downstream side of the discharge nozzle row 16*a* to the leading end of the recording sheet 13, away by a distance La. A reason for such a distance La is completely similar to that for the distance Lb described above with reference to FIG. 4. In addition, a conveying amount is preferably set equal to half or less of a length of the discharge nozzle row 16 in the recording sheet conveying direction. Thus, the length of the discharge nozzle row can be used highly efficiently.

Figure 23:
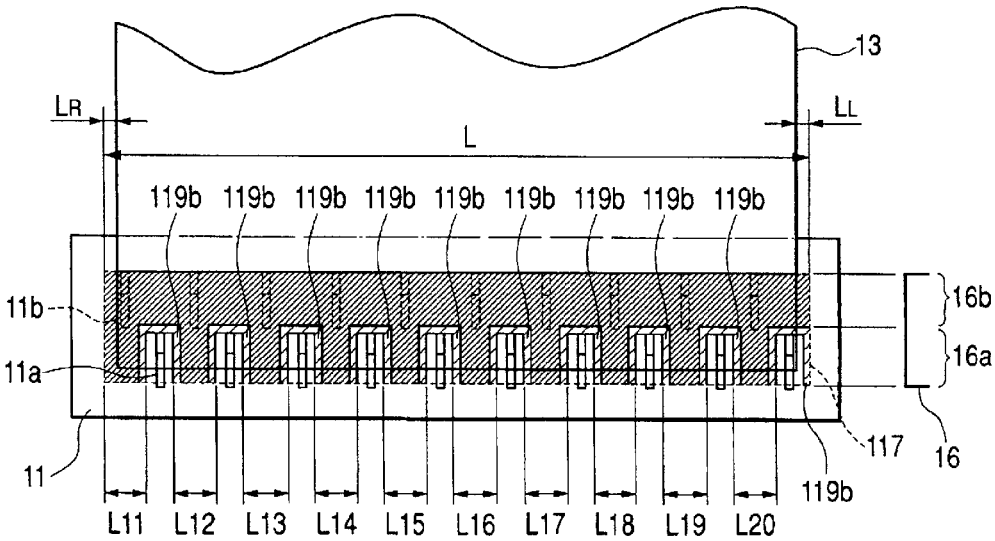
FIG. 23 is a schematic plan view showing the recording portion of the ink jet recording apparatus of the third embodiment of the invention.

Then, in step S26, the first region of the leading end recording data is masked. This masking is carried out for recording portions left unrecorded in the recording in steps S23 and S24. FIG. 23 is a schematic plan view showing a second masking method of the leading end recording data. In the drawing, a reference numeral 119 denotes a second region of the leading end recording data. The data second region 119 is composed of a second region single portion 119*a* not superposed by the above-described data first region 118, and a second region superposed portion 119*b* superposed by the first region superposed portion 118*b*.

In the masking of step S26, since a portion left unrecorded in the masking of step S23 is recorded, the second region 119 of the leading end recording data is a region obtained by reversing the first region 118 of the leading end recording data with respect to the leading end recording data 117. As in the case of step S24, AND is taken from the leading end recording data 117 and the mask of the second region of the leading end recording data, and only recording data of a portion indicated by a hatched line in FIG. 23 is set as valid recording data.

That is, for the second region superposed portion 119*b*, a random mask pattern shown in FIG. 27B is used. AND is taken between a place indicated by a black circle in the drawing and the recording data to be set as discharge data, and this data is transferred through the data transfer circuit 66 to the recording head driver 67. By performing such a recording operation, a dot unrecorded during the recording head scanning in step S24 is recorded in a complementary manner, assuring recording of original 100% data.

Here, as can be understood from FIGS. 22 and 23, because of the presence of the first and second region superposed portions 118 and 119*b*, the total length of the recording data block in the main scanning direction Ltotal=(L1+L2+L3+L4+L5+L6+L7+L8+L9+L10)+(L11+L12+L13+L14+L15+L16+L17+L18+L19+L20) satisfies Ltotal>L in a relation with the valid recording length L of the main scanning direction.

Subsequently, in step S27, the second region is scanned by the second scanning of the carriage 30. This scanning may be carried out by the first scanning during returning in step S4, or by returning to the start of the first scanning, and then scanning in the same direction as that for the first scanning. In this case, a portion of the valid recording data where ink droplets are discharged to the outside of the recording sheet 13 is between the ribs of the platen rib row 11*a* because of a relation between the setting of the first region 118 of the leading end recording data and the platen rib rows 11*a* and 11*b*. Accordingly, no ink droplets are discharged onto the platen rib row 11*a*. As a result, ink droplets discharged outside the recording sheet 13 are all absorbed and recovered by the platen ink absorber 12.

Figure 19:
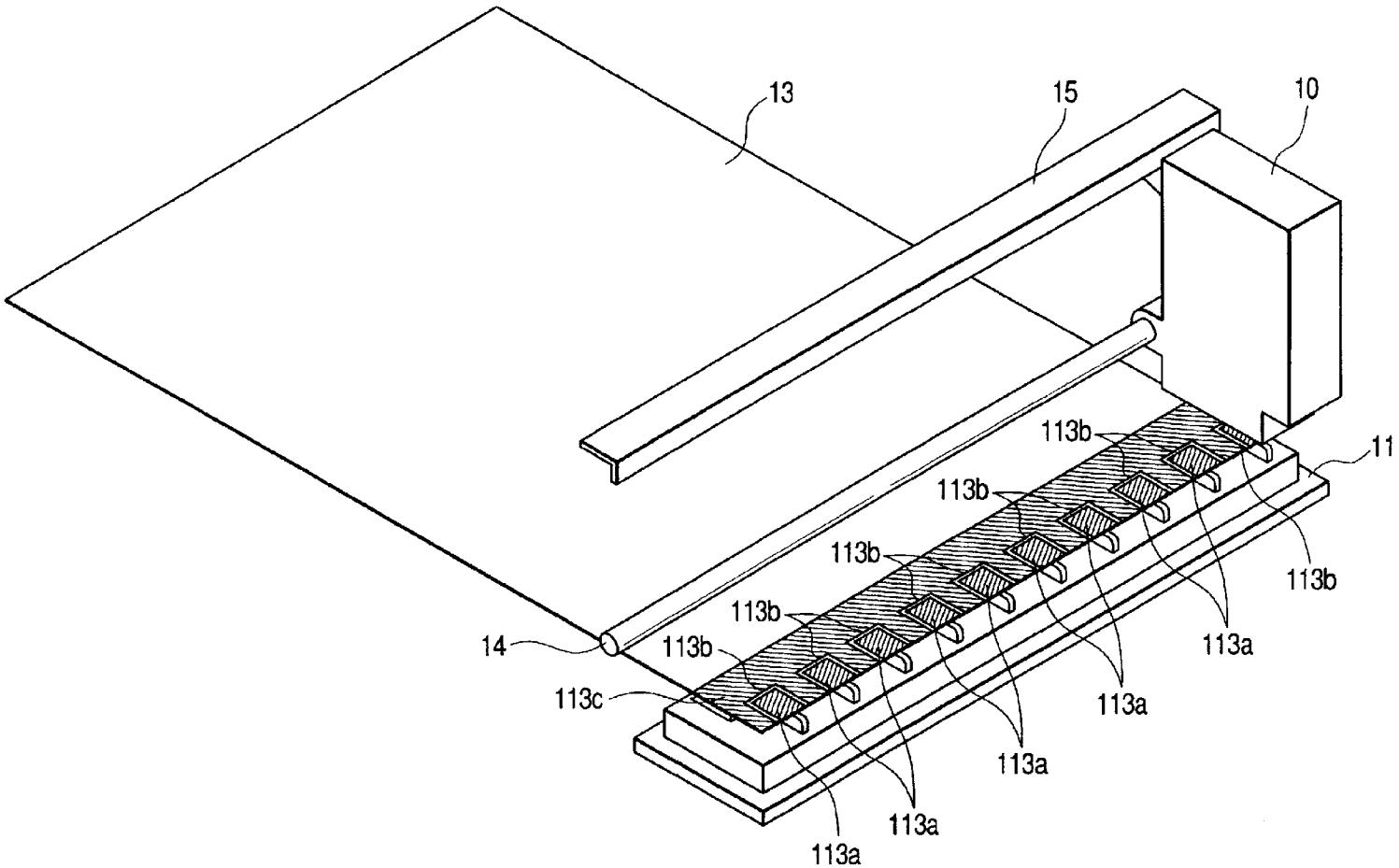
FIG. 19 is a schematic perspective view showing the recording unit of the ink jet recording apparatus of the third embodiment of the invention.

FIG. 19 shows a state after the end of the second scanning in the one-line recording operation. By forming a second recording region 113*b* on the recording sheet 13 by the second scanning, coupled with the first recording region 113*a*, one-line recording of the leading end recording data 117 is completed.

Thus, by providing the superposed portion in the boundary between the leading end first recording data 118 and the leading end second recording data region 119, and applying random pattern processing to this portion, a dot connecting position becomes random, making it possible to suppress the occurrence of visible white lines or black lines.

The method of recording with no blank spaces in the leading end of the sheet has been described.

In the foregoing, the description was made particularly of the recording with no blank spaces in the leading end portion of the recording sheet 13. In FIGS. 18, 19, 22 and 23 referenced above, recording is also made simultaneously with no blank spaces in the left and right ends, and thus this recording will be described.

Regarding recording with no blank spaces in the left and right ends of the recording sheet 13, if the carriage scanning direction positions of the recording sheet and the carriage 30 are in ideal states, it is possible to perform recording with no blank spaces by executing recording to the limit of the sheet end. In an actual case, however, because of dependence on the sheet setting accuracy or the like in the left and right directions by the user, ideal states are frequently far from being realized. To avoid such a problem, means can be taken to perform recording by using a sensor or the like to detect the left/right end position of the recording sheet 13. However, such means is not advisable if consideration is given to costs. Thus, by setting a real recording region width equal to/higher than the width of the recording sheet 13, it is realistic to perform recording with no blank spaces (recording with no margins) by discharging some ink droplets to the outside of the recording sheet 13. This system is also employed in the described embodiment.

Specifically, recording data is set to be wider than the set size of the recording sheet 13 by amounts Ll and Lr shown in FIG. 23. In the regions of Ll and Lr, the arrangements of the rib rows are predetermined so as to prevent the presence of ribs on the platen 11. This constitution prevents the sticking of ink droplets on the ribs of the platen 11 even if ink droplets are discharged outside the left or right end of the recording sheet, thereby enabling recording with no blank spaces to be performed. In addition, as recording data, it is necessary to prepare data having a length, which is obtained by adding L1 and Lr to the width of the recording sheet 13. In the case of this constitution, when a recording sheet having an unknown sheet width is inserted, although ink droplets may be stuck to the ribs of the platen 11, the sheets of standardized sizes are used in most cases, and thus there are no problems for practical purposes.

Figure 25:
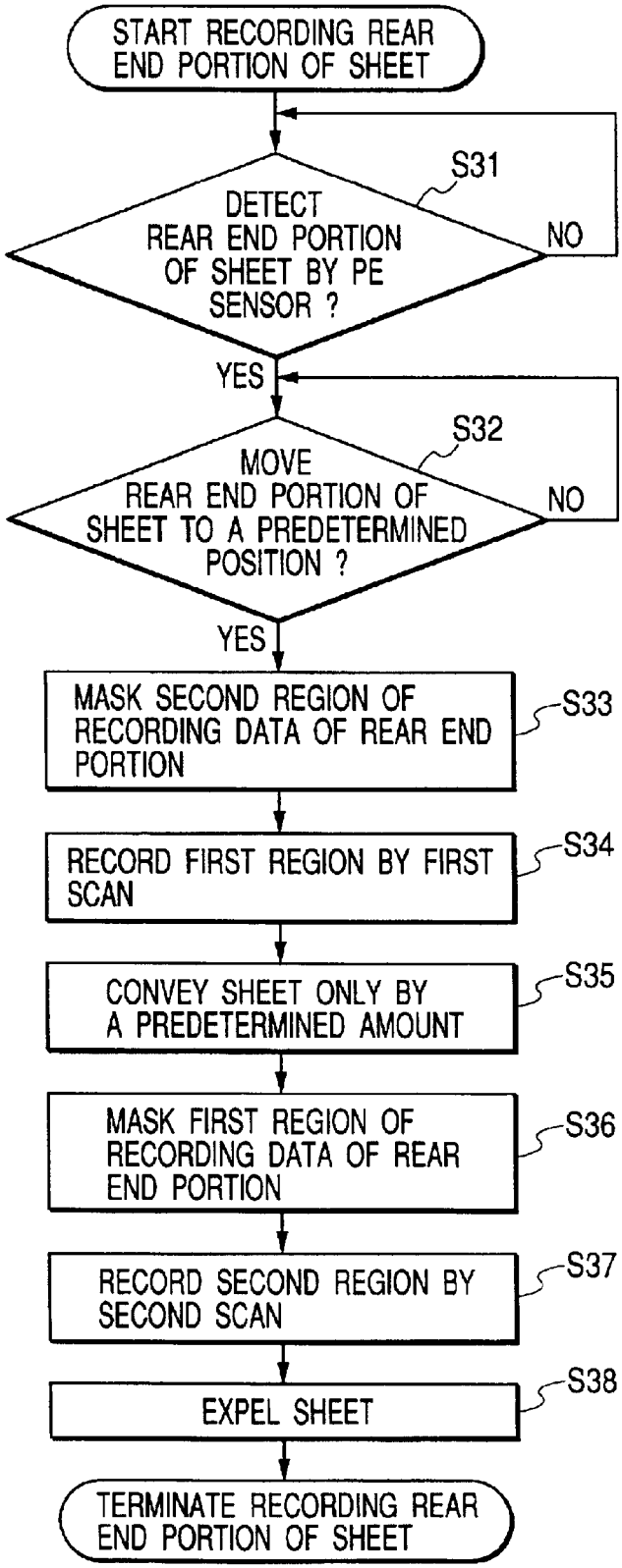
FIG. 25 is a flowchart schematically showing the recording operation of the ink jet recording apparatus of the third embodiment of the invention.

Next, description will be made of recording with no blank spaces in the rear end portion of the sheet by referring to the flowchart of FIG. 25, illustrating the recording operation of the rear end portion of the sheet.

In step S31, when the rear end of the recording sheet 13 is detected by a PE sensor, a recording operation is started on the rear end portion of the sheet. During the recording operation on the full surface of the sheet, the rear end portion of the recording sheet 13 is detected during the recording sheet conveyance in the middle of the recording operation, and thus the position of detecting the sheet rear end is stored in the memory.

Then, in step S32, determination is made as to the conveyance of the recording sheet 13 by a predetermined amount from the recording sheet rear end position previously detected and stored in the memory. Specifically, determination is made as to whether the rear end portion of the recording sheet 13 is in the range of the discharge nozzle row 16 or not. If the sheet rear end is determined to be in this range, then the process proceeds to next step.

Subsequently, in step S33, the second region of the rear end recording data is masked. Specific means is almost similar to that of the recording with no blank spaces in the sheet leading end, and thus only brief description will be made. That is, the recording data to be masked in this step is one located in the place of the same phase as that for the platen rib row 11*b*, and a region for random masking is provided in the boundary of the regions, where one-line recording is carried out in a divided manner. Now, the region for random masking will be described by referring to FIG. 20. In the drawing, a reference numeral 113*d* denotes an integrated portion of the first region single portion and an already recorded region; and 113*e* a first region superposed portion. For the first region superposed portion 113*e*, random masking is carried out by using a random mask pattern similar to that for the superposed region of the leading end portion of the recording sheet. Also for the recording end portion, it is necessary to prepare recording data having a length longer than that of the recording sheet 13 by foreseeing ink droplets to be discharged to the outside of the recording sheet 13.

Figure 20:
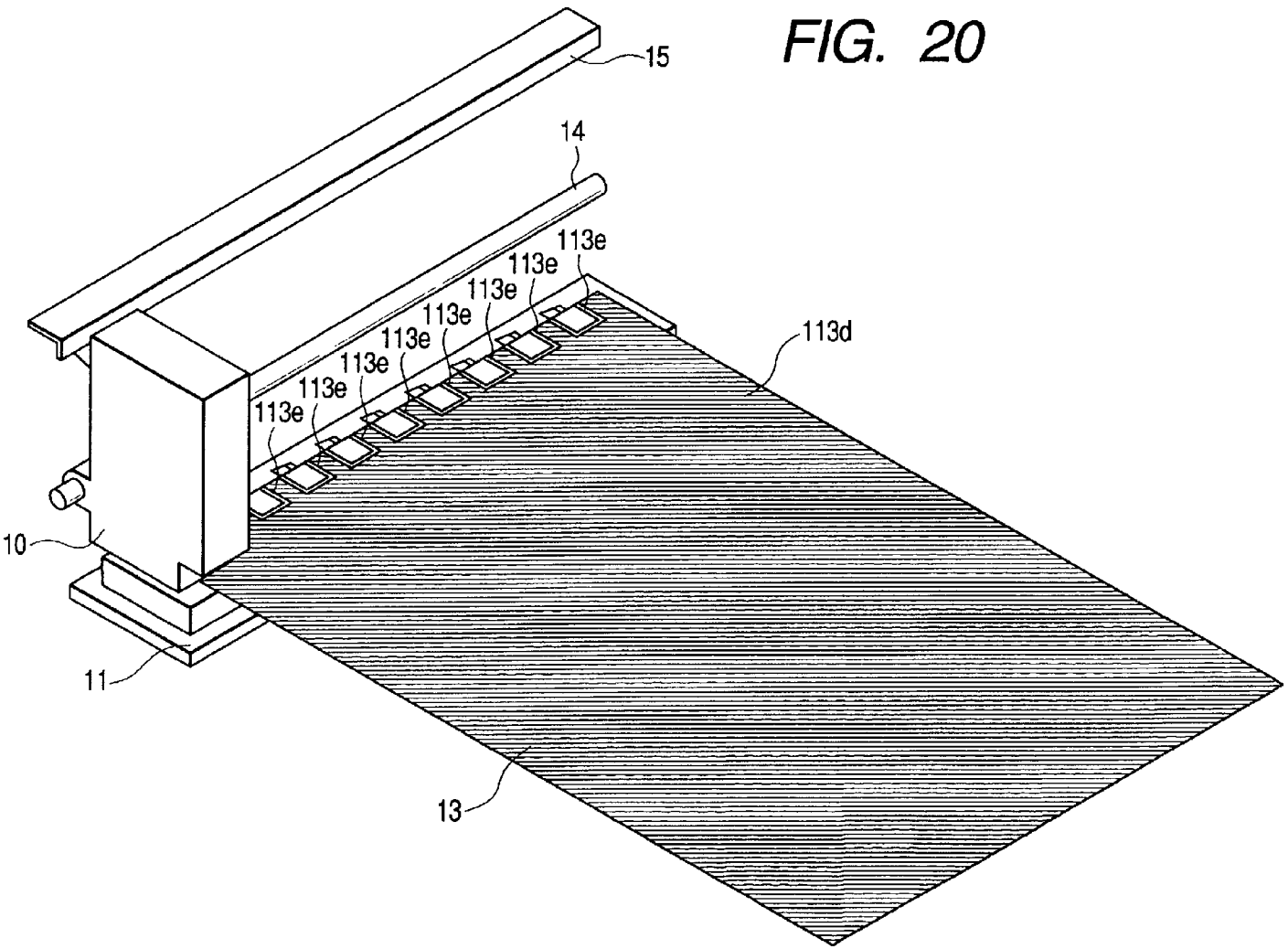
FIG. 20 is a schematic perspective view showing the recording unit of the ink jet recording apparatus of the third embodiment of the invention.

Then, in step S34, a first region is recorded by the first scanning of the carriage 30. The recording operation is similar to that for the recording with no blank spaces in the sheet leading end portion. Thus, the sticking of ink droplets onto the platen rib row 11*b* is prevented, and ink droplets discharged to the outside of the recording sheet 13 are directly absorbed and recovered by the platen ink absorber 12. FIG. 20 shows a state after the end of this recording operation of one line, where a region 113*c* integrating the region recorded before the sheet rear end recording with the first recording region by the first scanning, and a first region superposed portion 113*e* recorded with a 50% duty by random masking, are formed on the recording sheet 13.

Subsequently, in step S35, the recording sheet 13 is conveyed by a predetermined amount. The rear end of the recording sheet 13 after the conveyance by the predetermined amount is within the range of the discharge nozzle row 16*a*, and the amount of conveyance in this case should preferably be set equal to/lower than half of the length of the discharge nozzle row 16 in the recording sheet conveying direction.

Then, in step S36, the first region of the rear end recording data is masked. This masking is carried out for recording a portion unrecorded in steps S33 and S34. In other words, the recording data to be masked in this step is data located in the place of the same phase as that for the platen rib row 11*a*. Now, description will be made of a region to be subjected to random masking by referring to FIG. 21. In the drawing, a reference numeral 113*f* denotes a rear end second region superposed portion within the same range as that of the above-described rear end first region superposed portion; and 113*g* a rear end second region single portion. For the rear end second region superposed portion 113*f*, random masking is carried out by using a random mask having a complementary relation with the random mask used for the rear end first region superposed portion 113*e*.

Figure 21:
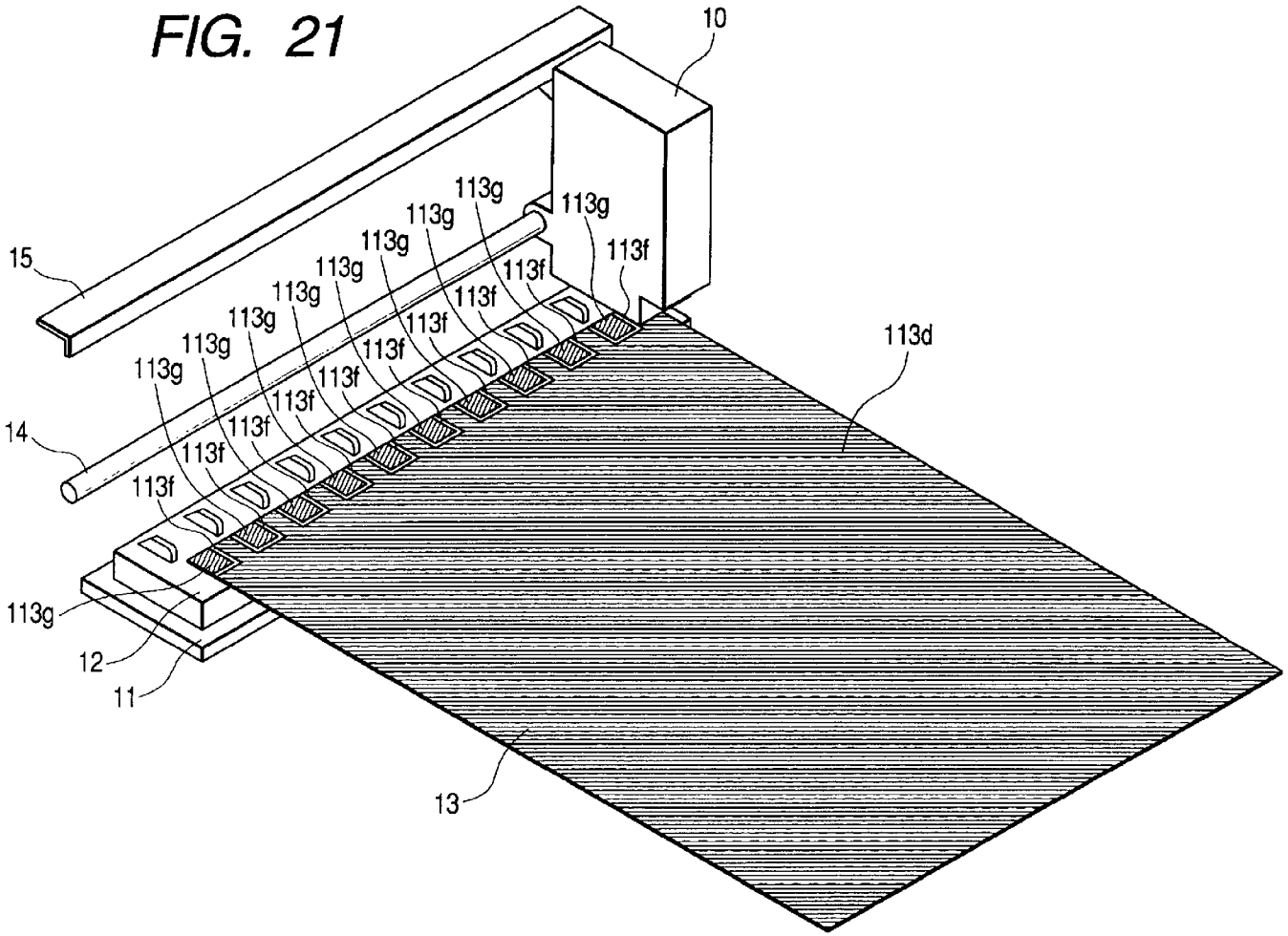
FIG. 21 is a schematic perspective view showing the recording unit of the ink jet recording apparatus of the third embodiment of the invention.

Then, in step S37, a second region is recorded by the second scanning of the carriage 30. The recording operation is similar to that for recording with no blank spaces in the sheet leading end portion. Thus, the sticking of ink droplets onto the platen rib row 11*a* is prevented, and ink droplets discharged to the outside of the recording sheet 13 are directly absorbed and recovered by the platen ink absorber 12. FIG. 21 shows a state after the end of the recording operation of one line, where the region 113*c* already recorded in step S34 is integrated with a region 113*d* recorded in step S37, thereby completing the recording on the full surface of the recording sheet 13.

Then, in step S38, the recording sheet 13 is expelled out of the recording apparatus. The expelling operation is carried out cooperatively by the discharge roller 37 and the not-shown gear as described above.

The method of recording with no blank spaces in the sheet rear end portion has been described.

Therefore, since recording with no blank spaces in the leading end, in the left and right ends, and in the rear end can be performed, it is possible to carry out recording with no blank spaces on the full surface of a predetermined recording sheet.

In the embodiment, the ribs of the platen rib row are arrayed at equal intervals. However, the invention is not limited to such an arrangement, and the ribs may be arranged at ununiform intervals. In such a case, each rib of the platen rib row A may be disposed roughly in the center between the adjacent ribs of the platen rib row B. The first and second regions 118 and 119 of the leading end recording data may respectively be set roughly in the centers between the ribs of the platen rib rows 11*b* and 11*a*, and a width of each in this case may be set about half of the rib interval.

In the embodiment, the one-line recording was carried out by a width equivalent to the length of the discharge nozzle row 16. However, the invention is not limited to such, and one-line recording may be carried out by a length equal to/lower than the length of the discharge nozzle row 16. This is very effective especially when recording resolution equal to/higher than the real resolution of the discharge nozzle row or the like is obtained.

As apparent from the foregoing, by constructing the ink jet recording apparatus according to the embodiment, it is possible to perform recording on the full surface of the recording sheet with no blank spaces without any complication or enlargement of the recording apparatus, and without any cost increases. To obtain a recording result with no blank spaces, it is not necessary for the user himself to perform secondary processing after the recording operation, thus improving operability. Moreover, it is possible to perform high image quality recording without generating any white or black lines in the boundary of data block.

Fourth Embodiment

In the fourth embodiment, recording of one line in the recording sheet conveying direction is performed through one path by one recording head scanning operation outside a superposed region. However, the invention is not limited to such, and it is possible to perform recording in the recording sheet conveying direction by superposing a plurality of paths.

Next, description will be made of another embodiment with reference to the accompanying drawings.

FIGS. 28A to 28G illustrate kinds of random masks when superposed regions are provided in main and sub scanning directions, and random masking is performed.

Figure 28A:
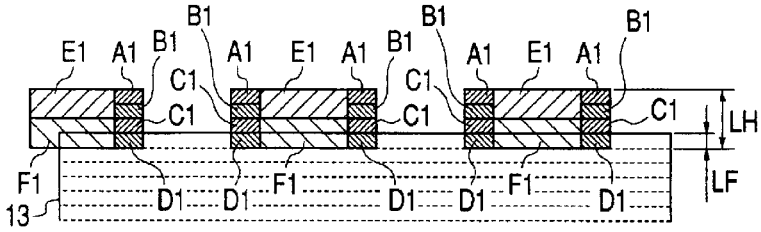
FIGS. 28A, 28B, 28C, 28D, 28E, 28F and 28G are schematic plan views, each showing a recording process of an ink jet recording apparatus according to a fourth embodiment of the invention.
Figure 28B:
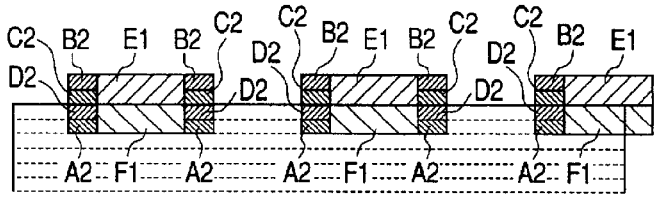
Figure 28C:
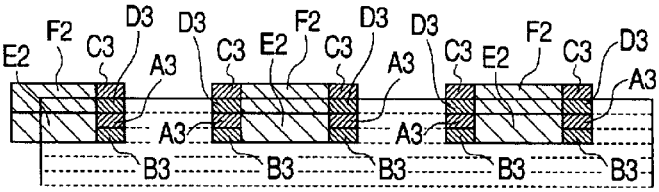
Figure 28D:
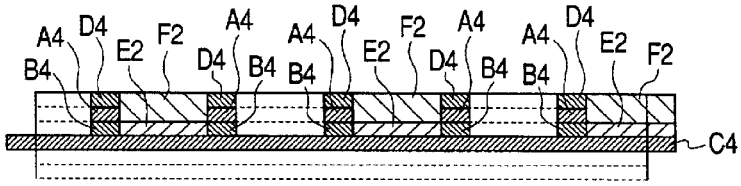
Figure 28E:
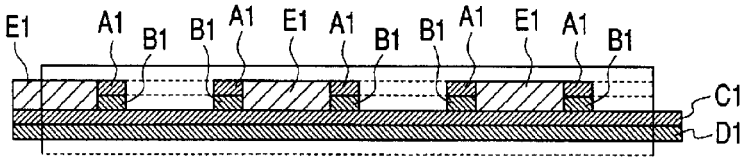
Figure 28F:
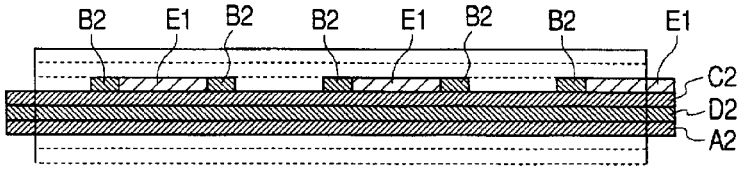

FIGS. 28A to 28G show stage changes accompanied by the recording sheet conveying of the sub scanning direction. First, as shown in FIG. 28A , recording of a first path is carried out in the main scanning direction by the width H of the recording head to convey the recording sheet in the sub scanning direction by LF. Then, as shown in FIG. 28B, recording of a second path is carried out in the main scanning direction by the width H of the recording head to convey the recording sheet in the sub scanning direction by LF. Similarly, thereafter, recording is carried out through paths one after another while conveying the recording sheet by a distance LF. When the recording head is passed through the same place of the recording sheet by four times, one-line recording is completed.

Figure 28G:
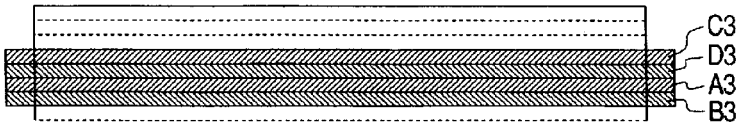

In FIGS. 28A to 28F, one-line recording is carried out based on two divisions as in the case of the recording operation of the leading end or the rear end portion of the recording sheet in the third embodiment. In FIG. 28G and after, one-line recording is carried out through one path.

According to the described embodiment, to complete recording by four recording head scanning operations, the recording width LH of the recording head for one operation is divided into four portions to give random mask pattern rows different from one another. To achieve a 100% recording density in a complementary manner by four recording head scanning operations, four kinds of random mask patterns are provided for each. In other words, since sixteen patterns are necessary, definition is provided by using a 4×4 matrix in the embodiment.

Figure 29:
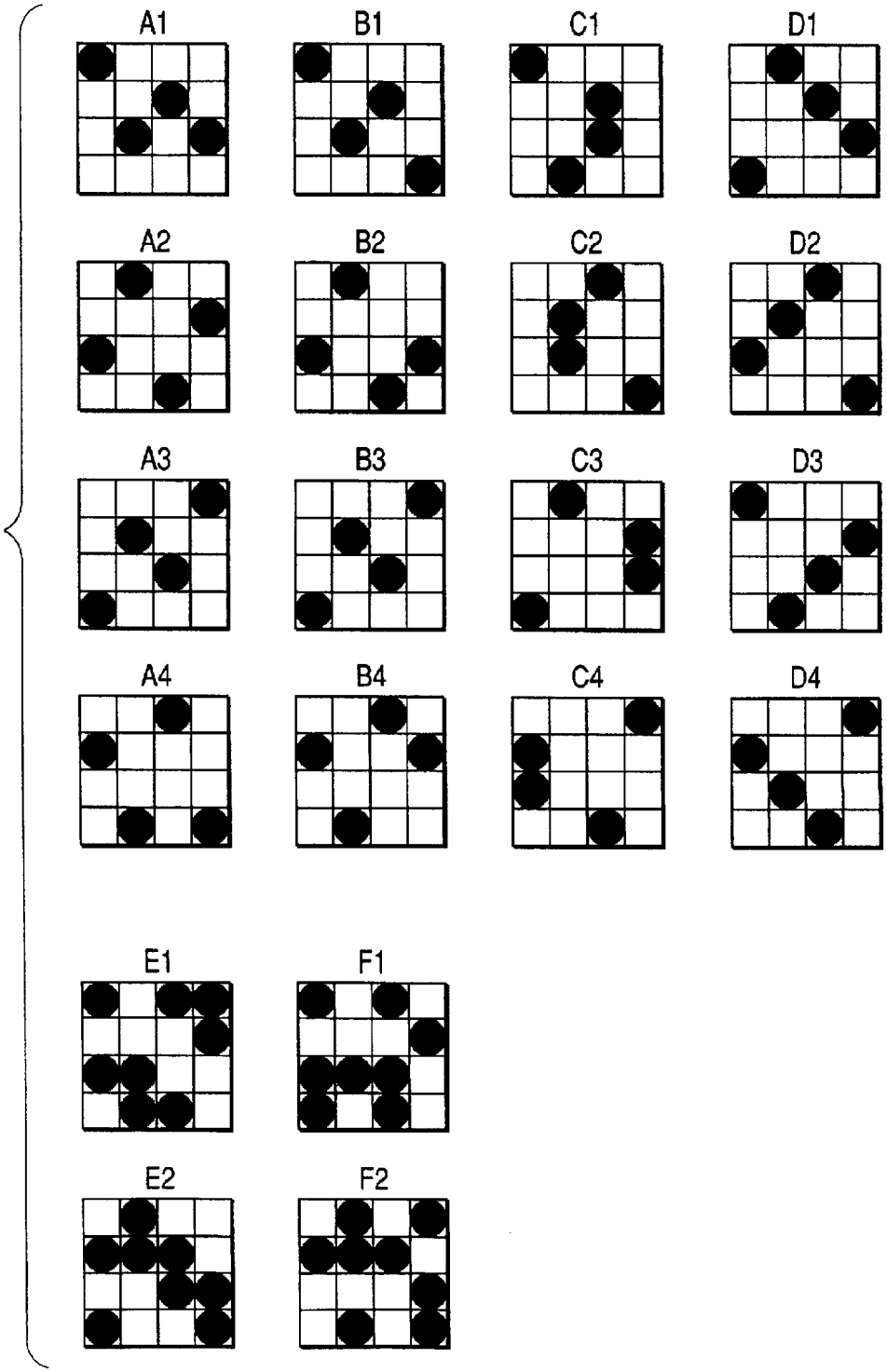
FIG. 29 is a schematic view showing mask patterns of the ink jet recording apparatus of the fourth embodiment of the invention.

FIG. 29 shows random mask patterns. A1 to A4 of FIG. 29, B1 to B4 of FIG. 29, C1 to C4 of FIG. 29, and D1 to D4 of FIG. 29 respectively show patterns of portions, in which recording is completed by four recording head scanning operations. E1 and E2 of FIG. 29, and F1 and F2 of FIG. 29 show patterns of portions, in which recording is completed by two recording head scanning operations. For example, if A1 to A4 of FIG. 29 are superposed at the same place, and recording is carried out, then a pattern of 100% duty is formed.

A random mask pattern is formed as shown in each of A1 to A4, B1 to B4, C1 to C4, D1 to D4, E1 to E2 and F1 to F2 of FIG. 29, and recording is performed based on the process shown in FIGS. 28A to 28G. Accordingly, the recording of 100% duty is carried out from the leading end of the recording sheet 13 to the full surface. In this case, since recording is carried out by a plurality of ink discharge nozzles different for one-line recording, characteristic ununiformity of the ink discharge nozzles is averaged out, making it difficult to see uneven concentration in the recording region.

As apparent from the foregoing, by constructing the ink jet recording apparatus according to the embodiment, compared with the third embodiment, it is possible to perform better recording on the full surface of the recording sheet with no blank spaces.

Fifth Embodiment

In the third and fourth embodiments, the recording data block was divided to be rectangular. However, the invention is not limited to such, and a constitution described below may be employed.

Figure 30A:
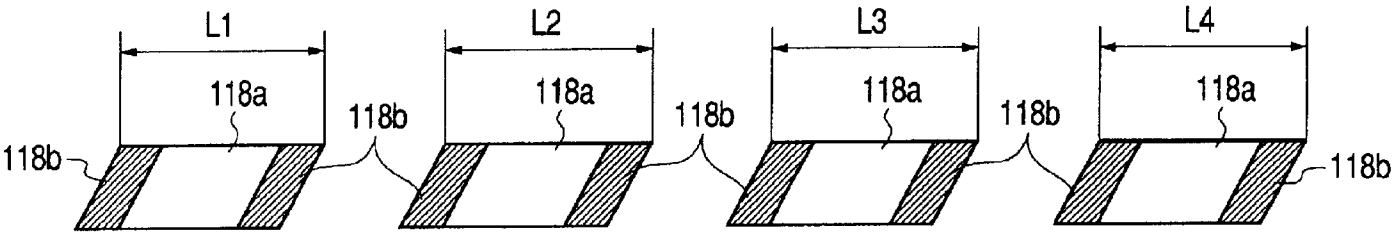
FIGS. 30A and 30B are schematic block diagrams, each showing recording data of an ink jet recording apparatus according to a fifth embodiment of the invention.
Figure 30B:
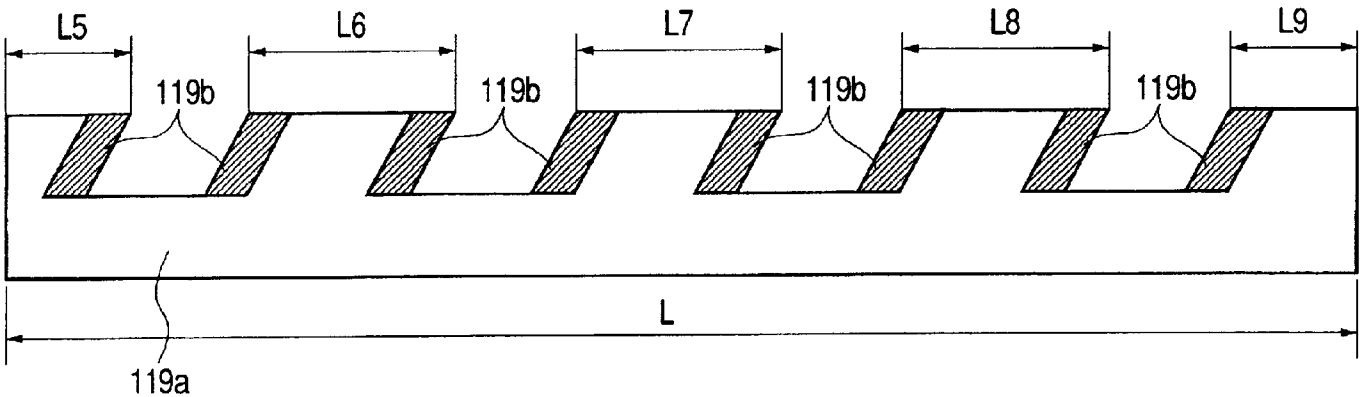
Figure 31:
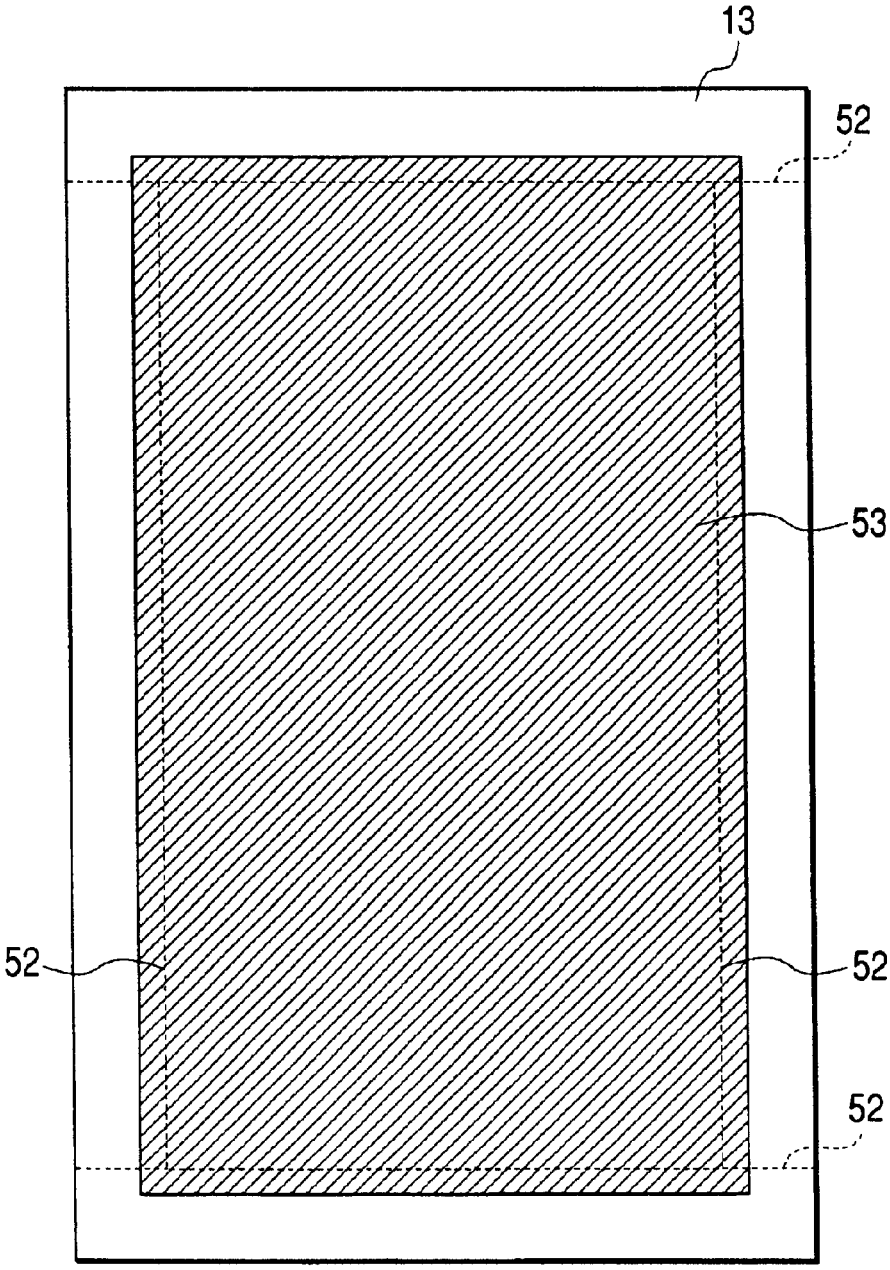
FIG. 31 is a schematic plan view showing a conventional example of recording with no blank spaces (recording without any margins).
Figure 32:
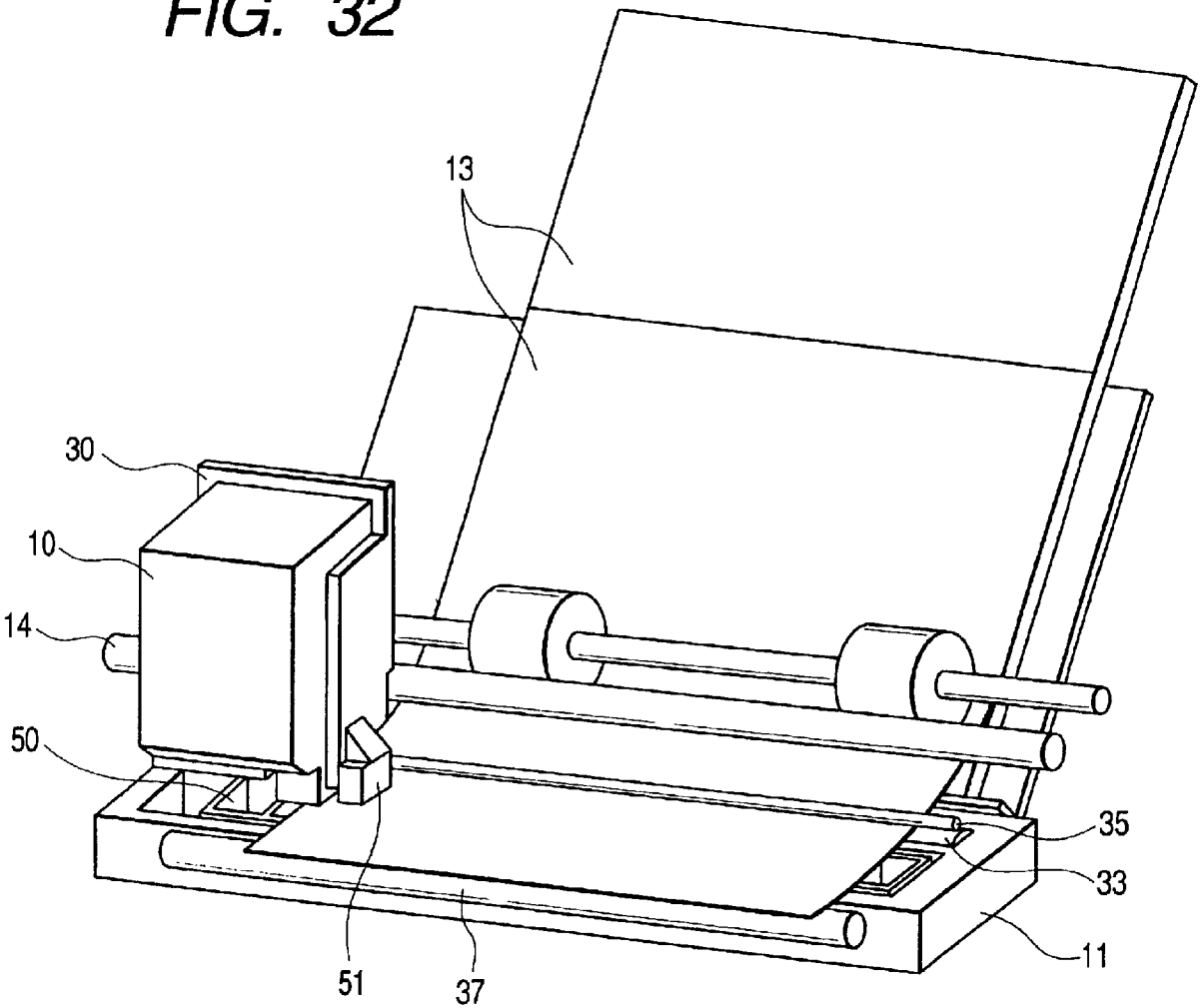
FIG. 32 is a schematic perspective view showing the conventional example of recording with no blank spaces (recording without any margins).

FIGS. 30A and 30B show the method of dividing a recording data block according to the fifth embodiment: each showing an example of a recording data block divided into a parallelogram. FIG. 30A shows a first region of leading end recording data; and FIG. 30B a second region of leading end recording data. Superposed portions 118 and 119 are respectively present in these regions, and recording is performed by applying a random mask pattern to a superposed portion. Also with this constitution, a total length of the recording data block in the main scanning direction Ltotal=L1+L2+L3+L4+L5+L6+L7+L8 and L9 satisfies Ltotal>L in a relation with a valid recording length L in the main scanning direction.

As apparent from the foregoing, by constructing the ink jet recording apparatus according to the embodiment, it is possible to perform high image quality recording without generating any visible white or black lines in the boundary of the data block.

Others

As the type of the recording apparatus of the invention comprising the recording mechanism, which uses the liquid ejection recording head, other than one used as the image output terminal of the information processor of the computer or the like, a copying device combined with a reader or the like, a facsimile device having a transmitting/receiving function, or the like may be employed.

As described above, according to each embodiment, it is possible to perform recording on the full surface of the recording medium with no blank spaces without any complication or enlargement of the recording apparatus, and without any cost increases.

Since it is not necessary for the user himself to perform any secondary processing after the recording operation to obtain a recording result with no blank spaces, operability can be improved.

Furthermore, since it is not necessary to add any secondary processing to the recording medium after the recording operation to obtain a recording result with no blank spaces, it is possible to obtain an extremely beautiful recording result without any degradation of recording medium finishing.

As apparent from the foregoing, according to the present invention, it is possible to perform recording on the full surface of the recording sheet with no blank spaces without any complication or enlargement of the recording apparatus, and without any cost increases. Moreover, it is possible to perform high image quality recording without generating any visible white or black lines in the boundary of the data block.

What is claimed is:

1. An ink jet recording method for conveying a recording medium onto a platen disposed to face a recording head for executing recording by discharging recording liquid droplets, to perform recording, comprising the steps of:

providing rib rows each including a plurality of ribs in a direction intersecting a conveying direction of the recording medium, the ribs of one rib row being arranged differently from ribs of another rib row, and disposing at least two rib rows on the platen separated in the conveying direction of the recording medium; and completing predetermined one-line recording by performing recording except for recording data corresponding to a position of each rib at each of at least the two rib rows when a recording operation is performed on a leading end or a rear end of the recording medium in the conveying direction thereof.

2. An ink jet recording apparatus for performing recording by conveying a recording medium onto a platen disposed to face a recording head for executing recording by discharging recording liquid droplets, comprising:

at least two rib rows disposed on the platen along a conveying direction of the recording medium, each rib row including a plurality of ribs in a direction intersecting the conveying direction of the recording medium, the ribs of one rib row being arranged differently from ribs of another rib row, wherein predetermined one-line recording is completed by performing recording except for recording data corresponding to a position of each rib at each of said at least two rib rows when a recording operation is performed on a leading end or a rear end of the recording medium in the conveying direction thereof.

3. An ink jet recording method for conveying a recording medium between a recording head for executing recording by discharging recording liquid droplets and a platen disposed to face the recording head, to perform recording, comprising the steps of:

dividing a discharge nozzle row of the recording head into at least two portions of a first nozzle row on the downstream side with respect to a conveying direction of the recording medium, and a second nozzle row on the upstream side with respect to the conveying direction of the recording medium;

using a platen including at least two rib rows separated in the recording medium conveying direction, each rib row having a plurality of ribs arrayed in a direction intersecting the recording medium conveying direction, the at least two ribs rows being divided near positions opposite a dividing line for dividing the first and second nozzle rows, and each rib of one rib row being disposed in a position between adjacent ribs of the other rib row;

executing two stages at least once each when a recording operation is performed on a leading end or a rear end of the recording medium with respect to the conveying direction, the first stage being for positioning the leading end or the rear end of the recording medium within a range of the second nozzle row, and recording a recording data first region equivalent to a part of recording data of one line by the recording head, using the range of the second nozzle row, in which the recording medium is present at this time or the ranges of the first and second nozzle rows, the second stage being for positioning the leading end or the rear end of the recording medium within a range of the first nozzle row, and recording a recording data second region equivalent to a remaining part of the recording data of one line by the recording head, using the ranges of the first and second nozzle rows, in which the recording medium is present at this time, or the range of the first nozzle row; and for the recording data first region, using recording data obtained by masking at least a position of each rib of the rib row on the upstream side with respect to the recording medium conveying direction for the entire recording data of one line, and for the recording data second region, using recording data obtained by masking at least a position of each rib of the rib row on the downstream side with respect to the recording medium conveying direction.

4. An ink jet recording apparatus for performing recording by conveying a recording medium between a recording head for executing recording by discharging recording liquid droplets and a platen disposed to face the recording head, said apparatus comprising:

a first rib row in a direction intersecting a conveying direction of the recording medium, including a plurality of ribs on the platen; and a second rib row in a direction intersecting the conveying direction of the recording medium, including a plurality of ribs on the platen, the ribs of said second rib row being arranged differently from the ribs of said first rib row, and disposed downstream of said first rib row with respect to the recording medium conveying direction, wherein a recording operation is performed on a leading end or a rear end of the recording medium, with respect to the conveying direction, by positioning the leading end or the rear end of the recording medium on said first rib row and performing recording except for recording data corresponding to a position of each rib of said first rib row, then positioning the leading end or the rear end of the recording medium in the conveying direction on said second rib row and performing recording except for recording data corresponding to a position of each rib of said second rib row.

5. An ink jet recording apparatus according to claim 4, wherein absorbing means is provided between ribs of at least one of said first and second rib rows to absorb recording liquid.

6. An ink jet recording apparatus according to claim 4, wherein in positions equivalent to rough centers between adjacent ribs of said first rib row, ribs of said second rib row are disposed.

7. An ink jet recording apparatus according to any one of claims 4 to 6, wherein one-line recording by a discharge nozzle row of the recording head is completed by dividing recording data according a position of each rib, and performing at least two or more recording operations accompanied by recording medium conveying in the midway when the recording operation is performed on the leading end or the rear end of the recording medium.

8. An ink jet recording apparatus according to claim 7, wherein when at least the two or more recording operations are executed accompanied by the recording medium conveying, a conveying amount of the recording medium in the midway is set equal to/lower than half of a length of the discharge nozzle row of the recording head in the recording medium conveying direction.

9. A recording apparatus comprising:

conveying means for conveying a recording medium in a predetermined conveying direction;

a recording head for recording on the recording medium conveyed by said conveying means; and at least two rib rows for guiding the recording medium conveyed by said conveying means at a position facing said recording head and having a plurality of ribs arranged in a direction intersecting the conveying direction of the recording medium, ribs of one of said rib rows being arranged in a pattern different from a ribs of another of said rib rows, wherein recording is performed on a leading end or a rear end of the recording medium, with respect to the conveying direction, by a plurality of recording operations performed by positioning the leading end or the rear end of the recording medium on each of said at least two rib rows, and each recording operation is performed on areas of the recording medium not including portions where the recording medium is supported by a rib and portions corresponding to a vicinity thereof.

10. A recording apparatus according to claim 9, wherein said recording head is a serial type ink jet recording head for performing recording by scanning in a main scan direction substantially perpendicular to the conveying direction to discharge ink.

11. A recording apparatus according to claim 10, wherein a total sum of a length of recording images performed on a leading end or a rear end of the recording medium by the plurality of recording operations in the main scan direction is longer than a length of a recording image actually recorded on the recording medium in the main scan direction.

* * * * *